US006215254B1

(12) United States Patent
Honda et al.

(10) Patent No.: US 6,215,254 B1
(45) Date of Patent: Apr. 10, 2001

(54) HIGH-VOLTAGE DISCHARGE LAMP, HIGH-VOLTAGE DISCHARGE LAMP DEVICE, AND LIGHTING DEVICE

(75) Inventors: Hisahi Honda; Seiji Ashida; Kiyoshi Saita, all of Yokosuka; Tatsuo Otabe, Tokyo; Masuo Shibuya; Noriji Watanabe, both of Yokosuka, all of (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 09/269,395

(22) PCT Filed: Jul. 24, 1998

(86) PCT No.: PCT/JP98/03314

§ 371 Date: Mar. 25, 1999

§ 102(e) Date: Mar. 25, 1999

(87) PCT Pub. No.: WO99/05700

PCT Pub. Date: Feb. 4, 1999

(30) Foreign Application Priority Data

| | | |
|---|---|---|
| Jul. 25, 1997 | (JP) | 9-200334 |
| May 28, 1998 | (JP) | 10-146872 |
| Jun. 2, 1998 | (JP) | 10-153338 |
| Jul. 10, 1998 | (JP) | 10-196322 |

(51) Int. Cl.[7] ..... H01J 9/32; H01J 61/36; H01J 5/26

(52) U.S. Cl. ..... 315/246; 313/623; 313/624; 313/625

(58) Field of Search ..... 315/246, 244, 315/260; 313/625, 623, 624, 622, 631, 634

(56) References Cited

U.S. PATENT DOCUMENTS

| | | | | |
|---|---|---|---|---|
| 5,424,609 | * | 6/1995 | Geven et al. | 313/624 |
| 5,552,670 | * | 9/1996 | Heider et al. | 313/624 |
| 5,861,714 | * | 1/1999 | Wei et al. | 313/625 |
| 5,932,955 | * | 8/1999 | Berger et al. | 313/318.02 |

FOREIGN PATENT DOCUMENTS

| | | |
|---|---|---|
| 18132/1991 | 9/1992 | (JP) . |
| 6-196131 | 7/1994 | (JP) . |
| 9-147803 | 6/1997 | (JP) . |
| 09317617 | 5/1998 | (JP) . |

* cited by examiner

*Primary Examiner*—Don Wong
*Assistant Examiner*—Wilson Lee
(74) *Attorney, Agent, or Firm*—Christensen O'Connor Johnson Kindness PLLC

(57) ABSTRACT

The present invention provides a high-voltage discharge lamp having an internal volume of 0.05 cc or less that is small yet maintains a desirable lifetime and a high luminous efficiency, a high-voltage discharge lamp device using the lamp, and a lighting apparatus using the lamp. The high-voltage discharge lamp comprises a ceramic discharge vessel that has a spherical, bulging section and a pair of small diameter cylindrical sections. The spherical, bulging section surrounds a discharge space. The small diameter cylindrical sections are connected to the ends of the spherical, bulging section. Electrode-integrated power-supplying conductors are used. Each conductor comprises a seal part and a halide-resistant part. The halide-resistant part having a proximal end connected to the distal end of the seal part. The distal end of the halide-resistant part projects into the spherical, bulging section of the translucent ceramic discharge vessel forming an electrode. A narrow gap is provided between the halide-resistant part and the inner surface of the small diameter cylindrical section. A discharge medium containing a metal halide and rare gas are filled in the translucent ceramic discharge vessel. When materials having a high average linear transmittance, such as YAG, are used as light-transmitting ceramics, the luminous efficiency of a small high-voltage discharge lamp will be increased.

28 Claims, 10 Drawing Sheets

HIGH-VOLTAGE DISCHARGE LAMP, HIGH-VOLTAGE DISCHARGE LAMP DEVICE, AND LIGHTING DEVICE

This is a United States national stage application of International application No. PCT/JP98/03314, filed Jul. 24, 1998, the benefit of the filing date of which is hereby claimed under 35 U.S.C. § 120, which in turn claims the benefit of Japanese application No. 9-200334, filed Jul. 25, 1997, Japanese application No. 10-146872, filed May 28, 1998, Japanese application No. 10-153338, filed Jun. 2, 1998, and Japanese application No. 10-196322, filed Jul. 10, 1998, the benefit of the filing date of which is hereby claimed under 35 U.S.C. § 119.

TECHNICAL FIELD

The present invention relates to a high-voltage discharge lamp that has a discharge vessel made of translucent ceramics, a high-voltage discharge lamp device that uses the lamp, and a lighting apparatus that uses the lamp.

BACKGROUND ART

A high-voltage discharge lamp, which comprises a discharge vessel encapsulating a pair of opposing electrodes and containing rare gas, a halide of light-emitting metal, and mercury, is used widely because it has relatively high efficiency and exhibits color rendering properties.

In recent years, a great demand has been made for small, high-efficiency light sources. High-pressure discharge lamps containing a halide of light-emitting metal are also now undergoing active development.

(Prior Art 1)

Jpn. Pat. Appln. KOKAI Publication No. 6-196131 discloses a structure comprising a ceramic discharge vessel, which contains a filler that can be ionized, including a metallic halide, and which surrounds a discharge space wherein the first and second electrodes are arranged. The discharge vessel has the first and second end sections connected to the ends of the center section that extends between the electrodes. Each end section surrounds a power-supplying conductor connected to the electrode, with some gap between it and the conductor. A seal made of ceramic-sealing compound is provided at a position where the power-supplying conductor protrudes outwardly from the end section. At least the first end section has an outer diameter smaller than the minimum outer diameter of the center section. The power-supplying conductor passing through the first end section has a part opposing the discharge space and being resistant to the halide and a part which facing away from the discharge space and exhibiting permeability to hydrogen and oxygen. In this high-voltage discharge lamp, the halide-resistant part of the power-supplying conductor extends into the first end section for a distance L1 that is 2 mm longer than the inner diameter of the first end section. And the power-supplying conductor passing through the second end section also has a part which opposes the discharge space and which is resistant to the halide.

According to the prior art 1, the part exhibiting permeability to the hydrogen and oxygen will not corroded even if is exposed to halogen or liberated halide. This is because the distance L1, for which the halide-resistant part connected to the part exhibiting permeability to hydrogen and oxygen extends into the first end section, is 2 mm longer than the inner diameter of the first end section.

In the prior art 1, the halide-resistant part of the power-supplying conductor is a molybdenum rod having a diameter of 0.7 mm or the like. The electrode is connected to a tip of the molybdenum rod. The electrode has been formed by winding a single tungsten wire having a diameter of 0.17 mm, around the free end portion of a tungsten rod having a diameter of 0.3 mm and a length of 3 mm, said free end portion being 0.8 mm long.

Some embodiments of the prior art 1 are disclosed, including one whose rated lamp power is an intermediate value of 70 W, another which is lighted at 50 W, and still another which is lighted at 150 W.

(Prior Art 2)

Jpn. Pat. Appln. KOKAI Publication No. 9-147803 discloses a structure of a high-voltage discharge lamp that comprises a light-emitting bulb and a pair of electrodes provided in the light-emitting bulb. The light-emitting bulb is made of translucent ceramics and contains light-emitting substance. The end sections of the light-emitting bulb have an outer diameter small than the maximum diameter of the light-emitting section of the bulb. At least one of the end sections of the light-emitting bulb is sealed with a seal member and a conductor. The conductor is an integral combination of the electrode and an external lead wire. The length L1 of the end section of the light-emitting bulb and the length L2 of the junction between the end section and the conductor, which are connected by seal member, are defined as: $2\ \text{mm} \leqq L2 \leqq 20\ \text{mm}$, and $4\ \text{mm} \leqq L1-L2 \leqq 20\ \text{mm}$.

The prior art 2 aims at preventing a reaction between the light-emitting substance and the seal member, thereby to solve the problems such as drop of the lamp voltage, lighting failure due to a leak and deterioration in lifetime.

Embodiments of the prior art 2 are disclosed. One embodiment has a lamp power of 150 W and comprises a light-emitting bulb having an internal volume of 0.9 cc, each section of which is 15 mm long. Another embodiment has a lamp power of 200 W and comprises a light-emitting bulb having an internal volume of 0.75 cc.

(Prior Art 3)

Jpn. Pat. Appln. KOKAI Publication No. 10-144261 discloses a structure of a ceramic discharge bulb for use in a high-voltage discharge lamp. The profile of the inner wall of the discharge bulb defines an inner chamber that contains a light-emitting filler. The inner chamber has one major axis and two ends having an opening each. Electrically conductive bushings are fitted in the openings of the ends in airtight fashion and electrically connected to the electrodes, respectively. The electrodes are arranged in the discharge bulb, opposing each other and spaced from each other by an inter-electrode distance (EA). The profile of the inner wall of the discharge bulb has a specific geometric form. Namely, the profile is composed of a cylindrical center section and almost semispherical end sections. The center section is straight and has a length (L) and an inner radius (R), and the end sections have a radius (R) equal to the radius of the center section. The length (L) of the cylindrical center section is smaller than or equal to the inner radius (R) thereof (namely, $L \leqq R$). The inner length of the discharge bulb is at least 10% greater than the inter-electrode distance (EA) (that is, $2R+L>1.1\ EA$). The diameter (2R) of the discharge bulb is at least 80% of the inter-electrode distance (EA) and at most 150% of the inter-electrode distance (EA) (that is, $1.5\ EA \geqq 2R \geqq 0.8\ EA$).

The object of the prior art 3 is to render the temperature distribution uniform in the ceramic discharge bulb so that the bulb may be applied to all possible lamp postures.

According to the prior art 3, a special form is defined for the discharge bulb, whereby the wall load can be at most 45 $W/cm^2$ for a rated power of 20 W and at most 25 $W/cm^2$ for a high-power lamp.

The embodiments of the prior art 1 are all relatively large, high-voltage discharge lamps having a rated lamp power of 50 W or more. Thus, in the invention of the prior art 1, the electrodes are prepared independently of the power-supplying conductors, and the structure is adopted in which each electrode is connected to the tip of the halide-resistant part of the power-supplying conductor. This structure will encounter difficulty of assembling if it is applied to a small, high-voltage discharge lamp that has a lamp power of 35 W or less, for example 20 W.

In the prior art 1, a very narrow gap is provided between the inner surface of each end section of the ceramic discharge vessel and the halide-resistant part of the power-supplying conductor, and the shaft part of each electrode is located in the end section of the vessel. Therefore, each end section of the ceramic discharge vessel must be long enough to provide that narrow gap and to accommodate the shaft part of the electrode. That is, the end sections need to be longer than is necessary. The ceramic discharge vessel is inevitably long as a whole.

The prior art 1 was applied to such a small, high-voltage discharge lamp as described above. It was found extremely difficult to hold the coldest part at a low temperature to maintain the vapor pressure of the light-emitting metal at an optimal value, while keeping the temperature of the seal made of ceramic-sealing compound within a range to prevent the seal from being corroded by a halide.

Like the prior art 1, the prior art 2 is applied to relatively large, high-voltage discharge lamps having lamp powers of 150 W and 200 W. In these lamps, each electrode is connected to a conductor, forming an integral unit.

Only the relationship between the length L1 of the end section of the light-emitting bulb and the length L2 of the junction is defined to prevent reaction between the seal member and the light-emitting substance. In small, high-voltage discharge lamps, however, it is practically difficult for the prior art 2 to meet both the demand for the temperature of the seal made of ceramic-sealing compound and the demand for the temperature of the coldest part.

In the prior art 3, the discharge bulb is composed of a cylindrical center section and almost semispherical end sections connected to the ends of the center section. The length of the center section is defined on the basis of the radius R of the cylinder, and the inner length of the discharge bulb is defined on the basis of the inter-electrode distance, in order to render the temperature distribution uniform in the ceramic discharge bulb. In the embodiment shown in FIG. 1, each electrode is connected to a member 17 not shown. The lamp power of this embodiment is 70 W. This structure is similar to those of the prior art described above and can hardly be made smaller.

There is a demand, however, for a smaller high-voltage discharge lamp having a lamp power of 20 W or less, which is made of translucent ceramics and which has a long lifetime and a high efficiency.

To meet this demand, a small, high-voltage discharge lamp may be made, merely by reducing the sizes of the components of a conventional, relatively large, high-voltage discharge lamp, such as the discharge vessel and the electrodes. It was found, however, that a leak occurred at the seal in such a small lamp actually made, shortly after the lamp had been turned on. This is because the various modes of conveying heat to the seal from a heat source such as discharge plasma, i.e., heat conduction, convection and radiation, are unbalanced.

To realize small, high-voltage discharge lamps, the existing technology of high-voltage discharge lamps should therefore be reviewed thoroughly in order to create new specification that is suitable for small, high-voltage discharge lamps.

DISCLOSURE OF THE INVENTION

The main object of the present invention is to provide a high-voltage discharge lamp comprising a translucent ceramic discharge vessel, which is small and which yet has a desirable life time and a high luminous efficiency, and to provide a high-voltage discharge lamp device using the lamp and also a lighting apparatus using the lamp.

The secondary object of the present invention is to provide a high-voltage discharge lamp comprising a translucent ceramic discharge vessel, which has good optical efficiency, and to provide a high-voltage discharge lamp device using the lamp and also a lighting apparatus using the lamp.

The first high-voltage discharge lamp according to this invention is characterized by comprising: a translucent ceramic discharge vessel comprising a bulging section surrounding a discharge space and small-diameter cylindrical sections communicating with the ends of the bulging section and having an inner diameter smaller than the bulging section; electrode-integrated power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section, and each having a distal end projecting into the bulging section of the translucent ceramic discharge vessel and forming an electrode part; seals made of ceramic-sealing compound, each sealing a junction between one small-diameter cylindrical section of the translucent ceramic discharge vessel and one electrode-integrated power-supplying conductor; and a discharge medium containing a metallic halide and filled in the translucent ceramic discharge vessel.

In the present invention and each invention described below, the terms are defined to have the following technical meanings, unless otherwise specified:

(Translucent Ceramic Discharge Vessel)

"Translucent ceramic discharge vessel" means a discharge vessel made of light-transmitting and heat-resistant materials. Among these materials are: a single-crystal metal oxide such as sapphire; a polycrystalline metal oxide such as semi-transparent, airtight aluminum oxide, yttrium-aluminum garnet (YAG) or yttrium oxide (YOX); and a polycrystalline non-oxide such as aluminum nitride (AIN). The term "light-transmitting" is used in the sense that the light generated by discharge may be guided to the outside, passing through the discharge vessel. It may mean either transparency or light-diffusing property.

To manufacture the translucent ceramic discharge vessel, the bulging section, or center section, and the small-diameter cylindrical sections connected to the ends of the bulging section can be formed integral. Further, a cylinder for the bulging section, a pair of end plates to be fitted in and to close the end of the cylinder, and small-diameter cylindrical sections to be fitted in the center holes of the end plates to constitute the small-diameter cylindrical sections can be first preliminarily sintered, then assembled together, and finally sintered, thereby forming an integral discharge vessel.

(Electrode-Integrated Power-Supplying Conductors)

The electrode-integrated power-supplying conductor is used for at least one of the small-diameter cylindrical sections of the translucent ceramic discharge vessel.

"Power-supplying conductors" serve to supply power from a power supply through a ballast means, thus applying a voltage between the electrodes to start the high-voltage discharge lamp, or supplying a current to light the high-voltage lamp. They are sealed, in airtight fashion, to the small-diameter cylindrical sections by the means that will be described later.

"Electrode-Integrated" means that the distal part of each power-supplying conductor functions as an electrode. Namely, the electrode is made integral with the conductor, not being one formed independently and connected to the power-supplying conductor.

Each electrode-integrated power-supplying conductor has a seal part and a halide-resistant part.

"Seal part" is made of such material that the junction between it and the small-diameter cylindrical section may be sealed by the seal made of ceramic-sealing compound, which will be described later, or that it may be connected, if necessary, by a ceramic tube to the small-diameter cylindrical section. The seal part can be made of niobium, tantalum, titanium, zirconium, hafnium, or vanadium. These materials exhibit permeability to hydrogen and oxygen, though it does not matter whether or not the seal part allows passage of hydrogen and oxygen. If aluminum oxide is used, it is desirable that the seal part be made of niobium or tantalum, because niobium and tantalum have average thermal expansion coefficients, which are almost equal to those of aluminum oxide. Niobium and tantalum have average thermal expansion coefficients, which differ only a little from those of yttrium oxide and YAG. If aluminum nitride is used as the material of the translucent ceramic discharge vessel, the seal part should better be made of zirconium.

"Halide-resistant part" is made of material that is hardly corroded or is not corroded at all by the halide and liberated halogen present in the translucent ceramic discharge vessel, while the high-voltage discharge lamp is operating. The halide-resistant part is made of, for example, tungsten or molybdenum. Tungsten, which excels in heat resistance, is most preferred because the distal portion of the halide-resistant part extends into the translucent ceramic discharge vessel and forms an electrode part. The high-voltage discharge lamp according to the invention may be either an AC-driven lamp or a DC-driven lamp. In the case of an AC-driven, high-voltage discharge lamp, the power-supplying conductor provided at the anode side may not have an electrode part. Rather, it may be connected to the anode that is provided at the tip of the halide-resistant part.

A narrow gap is provided between the halide-resistant part and the small-diameter cylindrical section. While the lamp is being lighted, the residual halide in the form of liquid flows into this gap, forming the coldest part. The gap may be adjusted appropriately, thereby to set the coldest part can be set at a desired temperature.

(Seal Made of Ceramic-Sealing Compound)

The seal made of ceramic-sealing compound is applied at the end of each small-diameter cylindrical section, between the seal part and the small-diameter cylindrical section. When heated, the seal melts and flows into the gap between the seal part and the small-diameter cylindrical section, sealing the seal part and the section in airtight fashion. The seal secures the power-supplying conductor at a predetermined position.

It is desired that the seal part inserted in each small-diameter cylindrical section be completely covered with the above-mentioned seal. Moreover, the proximal portion of the halide-resistant part, which is connected to the seal part, may also be covered with the seal over a short distance. If so, the seal part will hardly be corroded by halide.

(Discharge Medium)

The discharge medium contains a metallic halide. The metal includes at least a light-emitting metal.

The halogen forming the metallic halide can be one or more selected from the group consisting of iodine, bromine, and fluorine.

The halide of light-emitting metal can be selected from the known metallic halides in accordance with the size and input power of the translucent ceramic discharge vessel, so as to acquire desired luminescent characteristics, such as luminescent color, average color rendering index Ra, luminous efficiency, and the like. The halide may be one or more selected from the group of halides of, for example, sodium Na, lithium Li, scandium Sc, and rare-earth metal.

Mercury can be contained, as buffer metal, in an appropriate amount. Instead of mercury, a halide of metal such as aluminum, which has a relatively high vapor pressure and which emits a small amount of light in the visible-light region, may be contained in the vessel.

As rare gas, argon, xenon, neon, and the like can be used.

(Operation of the First Invention)

The high-voltage discharge lamp according to the first invention is simple in structure, and can be easily assembled and can be made small, because at least one of the power-supplying conductors has a halide-resistant part the tip of which extends into the bulging section and constitutes an electrode.

Further, the small-diameter cylindrical section can be used in its entirety to provide a narrow gap since the shaft part of each electrode, which is a small diameter, does not extend into the small-diameter cylindrical section of the translucent ceramic discharge vessel. The length of the small-diameter cylindrical section can be reduced by the gap. This effectively works to miniaturize the high-voltage discharge lamp.

Still further, since the narrow gap and its length can easily be adjusted to optimal values, the seal part is maintained at a sufficiently low temperature, thereby lengthening the life time, and the coldest part is maintained at as high a temperature as possible, thereby increase the luminous efficiency.

The second high-voltage discharge lamp according to the present invention is of the same type as the first high-voltage discharge lamp of the invention and is characterized in that the following formula is satisfied:

$$0.2 \leqq \phi H/\phi S \leqq 0.6$$

where $\phi S$ (mm) is the diameter of each seal part and $\phi H$ (mm) is the diameter of each halide-resistant part.

In order to lower the temperature of each seal made of ceramic-sealing compound so as to prevent the seal from being corroded by halide, and to raise the temperature in the narrow gap so as to enhance the luminous efficiency, it suffices to make the seal part as thick as possible, thus lowering the heat resistance of the seal part, on the one hand, and increasing the heat resistance of the halide-resistant part, on the other hand.

In the second invention, the above-mentioned demand is satisfied by setting the diameter $\phi S$ (mm) of the seal part and the diameter $\phi H$ (mm) of the halide-resistant part at such values as would satisfy the formula specified above. If the diameter ratio 4H/+S is less than 0.2, the halide-resistant part will be too thin. If the diameter ratio $\phi H/\phi S$ exceeds 0.6, it will be maintain the temperature of the seal or and the temperature in the narrow gap at a desired value.

The third high-voltage discharge lamp according to the present invention is characterized by comprising: a translucent ceramic discharge vessel having an internal volume of 0.1 cc or less and comprising a bulging section and small-diameter cylindrical sections communicating with the ends of the bulging section, the bulging section having both ends drawn and given a continuous curved surface and having an average linear transmittance of 20% or more at a main part, and the small-diameter cylindrical sections having an inner diameter smaller than the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel.

In the third invention and the related inventions to be described below, the linear transmittance is one measured for an wavelength of 550 nm. "Average linear transmittance" is the arithmetic mean of linear transmittance values measured at five different points on the object.

If the translucent ceramic discharge vessel of the high-voltage discharge lamp has a high average linear transmittance, it is possible to increase the optical efficiency (luminaire efficiency) at which the lamp may cooperate with an optical system such as a reflecting mirror.

The translucent ceramic discharge vessels, which are used widely and which are made of aluminum oxide, have very high total transmittance. However, most of them perform diffused transmission, and their average linear transmittance does not reach 20%.

Hence, a high-voltage discharge lamps using a translucent ceramic discharge vessel made of aluminum oxide cannot attain as high an optical efficiency as is desired.

In order to enhance the average linear transmittance of a translucent ceramic discharge vessel to 20% or more, it would be essential to use ceramics of hexagonal structure and to use crystal grains of similar sizes, thereby to suppress the light scattering. As ceramics having hexagonal structure, YAG and yttrium oxide (YOX) can be used.

In the present invention, the average linear transmittance is generally 20% or more, preferably 30% or more, and more preferably 45% to 70%. If the average linear transmittance exceeds 80%, the crystal grains become too large, reducing the mechanical strength, and cannot be used in practice.

To increase the average linear transmittance, the translucent ceramic discharge vessel manufactured may be polished either chemically or mechanically.

The main part of the bulging section is that part which opposes between the electrodes.

The ceramics described above can serve to provide a discharge vessel comprising a bulging section and small-diameter cylindrical sections, which are formed integral and which define a continuous curved surface. The translucent ceramic discharge vessel, thus provided, has no part that is discontinuous optically or thermally. This is vitally important, particularly for a small translucent ceramic discharge vessel that has an internal volume of 0.1 cc or less and that is designed to high-voltage discharge lamps which excel in light-distribution characteristic and which hardly have cracks.

The internal volume of the translucent ceramic discharge vessel is measured in the following way. First, water is poured into the discharge vessel. The open end of each small-diameter cylindrical section is then closed after the vessel is filled with water.

Finally, the water is drained from the vessel, and the amount of the water drained is measured.

A narrow gap can be provided between the halide-resistant part and the inner surface of the small-diameter cylindrical section, in the vicinity of both power-supplying conductors. Nonetheless, it suffices to provide a narrow gap in the vicinity of only one of the power-supplying conductors.

The fourth high-voltage discharge lamp according to the invention is of the same type as the third high-voltage discharge lamp of this invention and is characterized in that the translucent ceramic discharge vessel has an internal volume of 0.05 cc or less.

The smaller the internal volume of the translucent ceramic discharge vessel, the greater the optical advantage resulting from the high average linear transmittance of the discharge vessel. If the internal volume is 0.05 or more, a remarkable advantage can be obtained.

The fifth high-voltage discharge lamp according to the invention is characterized by comprising: a translucent ceramic discharge vessel comprising a bulging section having a maximum outer diameter $d_B$ (mm) and a length $L_B$ (mm) and a pair of small-diameter cylindrical sections connected to the ends of the bulging section, each having an outer diameter $d_T$ (mm) and a length $L_T$ (mm); a pair of electrodes sealed in the small-diameter cylindrical sections and located in the bulging section; and a discharge medium containing a light-emitting metal halide and a rare gas and filled in the translucent ceramic discharge vessel, the vessel satisfying the following formulas:

$$1 \leqq d_B/d_T \leqq 3.5$$

$$1.6 \leqq L_T/L_B \leqq 4.5$$

A high-voltage discharge lamp using a translucent ceramic discharge vessel can have an operating temperature, which is higher by 100° C. or more than the operating temperature of a lamp having a quartz-glass vessel. This is because translucent ceramic withstands higher temperature than quartz glass; aluminum oxide, for example, withstands high temperatures up to 1000° C. Hence, even if mercury is used as buffer metal or if a halide of aluminum is used as buffer metal instead, the luminous efficiency can be raised by maintaining the coldest part at a high temperature.

However, the seals used in a translucent ceramic discharge vessel need to be maintained at a low temperature, for the following reason. Generally, such seals are made of vitreous ceramic seal compound. They are heated and melted, made to flow into the gap between the members to be sealed together. These seals are corroded when they contact a metallic halide heated at high temperature, inevitably causing a leak.

It is therefore necessary to space each seal away from the coldest part and to impart an appropriate temperature gradient between the seal and the coldest part. To this end, the translucent ceramic discharge vessel is made to have small-diameter cylindrical sections, and a narrow gap is provided between each small-diameter cylindrical section and the power-supplying conductor penetrating into the cylindrical section. The performance should greatly change, depending upon these values.

The fifth invention aims to provide a relatively small, high-voltage discharge lamp in which the values of the translucent ceramic discharge vessel achieving high performance are specifically defined, thereby imparting a high luminous efficiency and a sufficient life time to the discharge lamp.

In the fifth invention, the maximum outer diameter $d_B$ and length $L_B$ of the bulging section of the translucent ceramic discharge lamp and the maximum diameter $d_T$ and length $L_T$ of each small-diameter cylindrical section have relationship represented by the formulas described above. The reason why will be explained below.

If the outer-diameter ratio $d_B/d_T$ is less than 1, the small-diameter cylindrical sections will become thick, and their thermal capacity will increase, excessively lowering the temperature of the coldest part. Therefore, the ratio should not be less than 1.

Conversely, if the ratio $d_B/d_T$ exceeds 3.5, the small-diameter cylindrical sections will become thin, an excessively steep temperature gradient will develop in their axial direction, and the vessel will likely have cracks due to strain. Hence, the ratio should not exceed 3.5.

If the length ratio $L_T/L_B$ is less than 1.5, the small-diameter sections will become short, and their sealing reliability will decrease. The ratio should not be less than 1.5. Conversely, if the ratio $L_T/L_B$ exceeds 4.5, the small-diameter sections will become long, and their thermal capacity will increase, lowering the temperature of the coldest part and decreasing the luminous efficiency too much. Therefore, the ratio should not exceed 3.5.

Other structural features will be explained.

If necessary, the translucent ceramic discharge vessel can be set in an envelope. The envelope is evacuated and introducing inactive gas into the envelope under an appropriate pressure. Then, the conductors provided in the envelope can be prevented from being oxidized.

The envelope may be evacuated, generating a vacuum in it. If so, the temperature gradient on the surface of the translucent ceramic discharge vessel can be decreased. This prevents cracks from developing in the discharge vessel if the vessel is made of ceramics.

The operation of the fifth invention will be explained.

In the fifth invention, the ratio in length between, and the ratio in maximum outer diameter between, the bulging section and each small-diameter cylindrical section of the translucent ceramic vessel are set within specific ranges, respectively. The temperature gradient in the axial direction of the small-diameter cylindrical section therefore falls within an allowable range. The temperature of each seal can be lowered, and the vessel will hardly have cracks due to strain. The lifetime of the lamp can thereby be lengthened.

In addition, the temperature of the coldest part can be raised within a allowable range, whereby a high luminous efficiency is attained. Further, the reliability of the seal parts do not decrease.

The sixth high-voltage discharge lamp according to the present invention is of the same type as the third high-voltage discharge lamp and is characterized in that the translucent ceramic discharge vessel satisfies the following formulas:

$$2 \leqq d_B/d_T \leqq 3.2$$

$$2 \leqq L_T/L_B \leqq 3.7$$

In the sixth invention, ranges more desirable than those specified in the fifth invention are defined.

The seventh high-voltage discharge lamp according to the present invention is characterized by comprising: a translucent ceramic discharge vessel comprising a spherical bulging section and small-diameter cylindrical sections communicating with the ends of the bulging section and having an inner diameter smaller than the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel, the spherical bulging section having a ratio RD of the minor diameter to the major diameter, which satisfies the following formula:

$$0.3 \leqq R_D \leqq 1.0$$

The major diameter and the minor diameter are defined by the inner surface of the bulging section.

The minor diameter is the maximum inner diameter, which extends through the center part of the bulging section.

The major diameter is obtained by approximation, because the small-diameter cylindrical sections are continuous to the apices of an ellipsoid. That is, two straight lines are drawn from the inner surface of the center part of the bulging section to the inner surfaces of the small-diameter cylindrical sections. And the distance between the intersections of these lines with the major axis of the ellipsoid is regarded as the major diameter. If $R_D$ is 1, the bulging section is truly spherical. This case falls within the scope of the present invention.

In the present invention, the bulging section is an ellipsoidal body, which satisfies the above-described condition. The bulging section of the translucent ceramic discharge vessel can have a uniform temperature distribution. The developing of cracks in the discharge vessel is therefore suppressed.

The eighth high-voltage discharge lamp is of the same type as the seventh high-voltage discharge lamp of the invention and is characterized in that the ratio RD of the minor diameter to the major diameter, which satisfies the following formula:

$$0.3 \leqq R_D \leqq 1.0$$

In the eighth invention, a range more desirable than that specified in the seventh invention is defined.

The ninth high-voltage discharge lamp according to the invention is characterized by comprising: a translucent ceramic discharge vessel comprising a bulging section surrounding a discharge space and small-diameter cylindrical sections communicating with the ends of the bulging section and having an inner diameter smaller than the bulging section, the vessel having a wall-thickness difference of 0.4 mm or less; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel.

In the ninth invention, a small wall-thickness difference is defined for the translucent ceramic discharge vessel. Therefore, the discharge vessel can have uniform temperature distribution, rendering uniform the resistance to heat conduction. The developing of cracks in the discharge vessel is thereby suppressed greatly. If the wall-thickness difference exceeds 0.4 mm, the temperature distribution will become non-uniform and cracks will likely develop.

The tenth high-voltage discharge lamp according to the invention is of the same type as the high-voltage discharge lamp of the ninth embodiment and is characterized in that the translucent ceramic discharge vessel is characterized in that the small wall-thickness difference is 0.2 mm or less.

In the tenth invention, a range more desirable than that specified in the ninth invention is defined.

The eleventh high-voltage discharge lamp according to the invention is characterized by comprising: a translucent ceramic discharge vessel having an overall length of 40 mm or less and comprising a bulging section and small-diameter cylindrical sections communicating with the ends of the bulging section, the bulging section having both ends drawn and given a continuous curved surface and having an average linear transmittance of 20% or more at a main part, and the small-diameter cylindrical sections having an inner diameter smaller than the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel.

The eleventh invention defines the maximum overall length possible for a translucent ceramic discharge vessel which is small and can yet have high optical efficiency and which is fit for use in a high-voltage discharge lamp.

In reducing the present invention to practice, the average linear transmittance can be 20 to 80%.

The twelfth high-voltage discharge lamp according to the invention is of the same type as the eleventh high-voltage discharge lamp of the invention and is characterized in that the translucent ceramic discharge vessel has an over-all length of 30 mm or less.

In the twelfth invention, a range more desirable than that specified in the eleventh invention is defined.

The thirteenth high-voltage discharge lamp according to the invention is characterized by comprising: a translucent ceramic discharge vessel comprising a bulging section and small-diameter cylindrical sections communicating with the ends of the bulging section, the bulging section having both ends drawn and given a continuous curved surface and having an average linear transmittance of 20% or more at a main part, and the small-diameter cylindrical sections having an inner diameter smaller than the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel, and the lamp has a rated lamp power of 35 W or less.

The thirteenth invention defines a general range for the rated lamp power for a small, high-voltage discharge lamp.

The fourteenth high-voltage discharge lamp according to this invention is of the same type as the fourteenth high-voltage discharge lamp of the invention and is characterized in that the rated lamp power is 20 W or less.

In the fourteenth invention, a range of rated lamp power more desirable for miniaturization of the lamp, than the range for the thirteenth invention, is defined.

The fifteenth high-voltage discharge lamp according to the present invention is characterized by comprising: a translucent ceramic discharge vessel comprising a bulging section and small-diameter cylindrical sections communicating with the ends of the bulging section, the bulging section having both ends drawn and given a continuous curved surface and having an average linear transmittance of 20% or more at a main part, and the small-diameter cylindrical sections having an inner diameter smaller than the bulging section and having an average linear transmittance smaller than that of the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel.

In the fifteenth invention, an average linear transmittance is defined for the small-diameter cylindrical sections of the translucent ceramic discharge vessel.

The higher the average linear transmittance of each small-diameter section, the lower the luminous efficiency, and the higher the probability of cracking that may occur in the small-diameter section during the manufacture of the lamp. For example, when the average linear transmittance of a translucent ceramic discharge vessel was increased from about 20% to 45%, the optical efficiency (luminaire efficiency) increased about 30%. In this case, however, the luminous efficiency (lm/w) decreased decrease about 3%, and the rate of sealing failure during the manufacture of the lamp increased about 30%.

These values depend upon the rated lamp power, the material and shape of the translucent ceramic discharge vessel, and the like. But it was found that they changed in the same manner as described above.

The values changed that way, probably because the temperature of the coldest part in each small-diameter section lowered as the average linear transmittance increased. The increase in the rate of the sealing failure during the manufacturing of the lamp can be attributed to cracks that developed in the translucent ceramic discharge vessel in the following process. In the sealing by using the ceramic-sealing compound, the average linear transmittance of each small-diameter section increased. As a result, the temperature gradient in the axial direction of the small-diameter section increased, inevitably generating strain. The strain resulted in the cracks.

In the fifteenth invention, the decrease in the luminous efficiency and the sealing failure during the manufacture of the lamp are minimized by increasing the average linear transmittance of at least the main part of the bulging section, thereby raising the optical efficiency (luminaire efficiency), and by maintaining the average linear transmittance of the small-diameter sections at a small value.

The following modifications can be made in practicing the fifteenth invention:

1. The average linear transmittance of the main part of the bulging section is 20 to 80%.
2. The average linear transmittance of the main part of the bulging section is 20% or more and is 5% greater than the average linear transmittance of each small-diameter section.
3. The average linear transmittance of each small-diameter section is 5 to 50% and is less than the average linear transmittance of the main part of the bulging section.

The sixteenth high-voltage discharge lamp according to the invention is of the same type as the eleventh to fifteen high-voltage discharge lamps of the invention and is characterized in that the bulging section of the translucent ceramic discharge vessel has at its main part an average linear transmittance of 30% or more.

In the sixteenth invention, a range more desirable than that specified in the fifteenth invention is defined.

The seventeenth high-voltage discharge lamp according to the invention is characterized by comprising: a translucent ceramic discharge vessel comprising a bulging section surrounding a discharge space and small-diameter cylindrical sections communicating with the ends of the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel, and is characterized in that a ratio $R_L$ of the total weight (g) to the rated lamp power (W) satisfies the following formula:

$$0.7\times10^{-2}\leq R_L\leq 2.5\times10^{-2}$$

In the case of a conventional large lamp having a large rated lamp power, the temperature of the components, such as the temperature of the coldest part, which determines the luminous efficiency, and the temperature of the seals made of ceramic-sealing compound, which determines the life time of the seals, are greatly influenced by various parameters, such as the material of the translucent ceramic discharge vessel (e.g., aluminum oxide or YAG), the shape of the discharge vessel (spherical or ellipsoidal), and the structures of the electrodes and power-supplying conductors.

Therefore, every high-voltage discharge lamp manufacturer has been optimizing the parameters in accordance with their own design guideline.

The inventor hereof has found that a high-voltage discharge lamp having a rated lamp power of about 20 W or less and comprising a translucent ceramic discharge vessel has its characteristics, such as luminous efficiency and life time, determined almost primarily by the total weight of the lamp and the effective power supplied, i.e., the rated lamp power. This finding can not been anticipated at all in the conventional lamps which have a relatively large size and a relatively large lamp power.

It is on the basis of this finding that the seventeenth invention described above has been made.

If the ratio $R_L$ is less than $0.7\times10^{-2}$, the reliability to the lifetime will lower extremely. If the ratio $R_L$ exceeds $2.5\times10^{-2}$, the temperature of the coldest part of the lamp will lower, decreasing the luminous efficiency very much. Neither the reliability nor the temperature is influenced so much by the ceramic material of the ceramic discharge vessel or by the electrodes.

Thus, the seventeenth invention can provide a small, high-voltage discharge lamp that as a long lifetime and high luminous efficiency.

The eighteenth high-voltage discharge lamp according to the present invention is of the same type as the seventeenth high-voltage discharge lamp of the invention and is characterized in that the ratio $R_L$ of the total weight (g) to the rated lamp power (W) satisfies the following formula:

$$0.8\times10^{-2}\leq R_L\leq 2.0\times10^{-2}$$

In the eighteenth invention, a range more desirable than that specified in the seventeenth invention is defined.

The nineteenth high-voltage discharge lamp according to the invention is characterized by comprising: a translucent ceramic discharge vessel comprising a bulging section surrounding a discharge space and small-diameter cylindrical sections communicating with the ends of the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel, and is characterized in that a ratio $R_E$ of the total weight (g) of the translucent ceramic discharge vessel to the rated lamp power (W) satisfies the following formula:

$$0.5\times10^{-2}\leqq R_E\leqq 2.2\times10^{-2}$$

The inventor hereof has found that a high-voltage discharge lamp having a rated lamp power of about 20 W or less and comprising a translucent ceramic discharge vessel, just like the seventeenth invention and the eighteenth invention, has its characteristics, such as luminous efficiency and life time, determined almost primarily by the total weight of the lamp and the effective power supplied, i.e., the rated lamp power. This finding can not been anticipated at all in the conventional lamps which have a relatively large size and a relatively large lamp power.

It is on the basis of this finding that the nineteenth invention described above has been made.

The twentieth high-voltage discharge lamp according to the present invention is of the same type as the nineteenth high-voltage discharge lamp and is characterized in that the ratio $R_E$ of the total weight (g) of the translucent ceramic discharge vessel to the rated lamp power (W) satisfies the following formula:

$$0.6\times10^{-2}\leqq R_E\leqq 1.8\times10^{-2}$$

In the twentieth invention, a range more desirable than that specified in the nineteenth invention is defined.

The twenty-first high-voltage discharge lamp according to the invention is characterized by comprising: a translucent ceramic discharge vessel comprising a bulging section surrounding a discharge space and having an inner diameter $r_I$ (mm), a first small-diameter cylindrical section communicating with one end of the bulging section and having a length L1, and a second small-diameter cylindrical section communicating with the other end of the bulging section and having a length L2 (mm); power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel, and is characterized in that the inner diameter $r_I$ of the bulging section and the lengths L1 and L2 of the first and second small-diameter cylindrical sections satisfy the following formula:

$$r_1/2<L1<L2$$

If a small, high-voltage discharge lamp, wherein two small-diameter cylindrical sections formed integral with and protruding from the ends of the bulging section of the translucent ceramic discharge vessel have the same length, is incorporated in a reflecting mirror and positioned coaxial therewith, one of the small-diameter cylindrical section will have a part protruding from the open end of the reflecting mirror. If so, the protruding part of the small-diameter cylindrical section is in the path of the light reflected from the reflecting mirror. This disturbs the distribution of light, and a shadow will appear in its center part.

If a high-voltage discharge lamp having small-diameter cylindrical sections of the same length is positioned vertically and turned on, the temperature of the small-diameter cylindrical section located above the other will rise much, and the seal will be corroded, giving rise to leak.

In the twenty-first invention, the small-diameter cylindrical sections have different lengths, and the shorter one has a length larger than the maximum diameter of the bulging section. Good sealing can therefore be achieved at the time of manufacturing the lamp.

When the lamp is incorporated into a reflecting mirror and positioned coaxial therewith, the short small-diameter cylindrical section may be arranged in the open end of the reflecting mirror, and the long small-diameter cylindrical may be arranged in the apical end of the reflecting mirror. In this case, the small-diameter cylindrical sections serve to fix the high-voltage discharge lamp in place, and the short small-diameter cylindrical section would not protrude from the open end of the bulging section.

If the high-voltage discharge lamp is positioned vertically and turned on, the long small-diameter cylindrical section may be positioned above the short one. In this case, the temperature of the seal rises but a little, thus inhibiting the occurrence of a leak.

The twenty-second high-voltage discharge lamp according to the invention is characterized by comprising: a translucent ceramic discharge vessel comprising a bulging section surrounding a discharge space and small-diameter cylindrical sections communicating with the ends of the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap of 0.21 mm or more between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel.

There is a demand for a smaller high-voltage discharge lamp having a lamp power of 20 W or less, which has a long lifetime and a high luminous efficiency.

The research the inventor hereof has conducted shows that such a smaller high-voltage discharge lamp cannot excellent characteristics by reducing the sizes of components of the conventional technology. Namely, the coldest part must be maintained at an appropriate temperature in order to achieve a sufficient luminous efficiency for a lamp of a small power. For this purpose it is essentially necessary to decrease the thermal capacity of the entire translucent ceramic discharge vessel. If the shape of the discharge vessel and the electrodes of a lamp of a relatively large power are reduced in size proportionally, a leak will occur at the seals within a short time after the lamp has been turned on. This is because the various modes of conveying heat to each seal from a heat source such as discharge plasma, i.e., heat conduction, convection and radiation, are unbalanced.

In the twenty-second invention, the narrow gap is set at a relatively large value. To this end the halide-resistant part of each electrode is made relatively thin, thereby increasing the heat resistance of the halide-resistant part. As a result, the heat conveyance from discharge plasma or the electrodes to the seals diminishes, successfully lowering the temperature of the seals. Therefore, a leak will hardly take place at each seal.

Better sealing can be accomplished if $Ln/L \geqq 0.31$, where L is the length of each seal part and Ln is the depth to which the seal part is inserted into the small-diameter cylindrical section.

The halide-resistant parts may have a length of 4.5 mm or more. In this case, it is easy to maintain the seals and the coldest part at desired temperatures.

The twenty-third high-voltage discharge lamp according to the invention is characterized by comprising: a translucent ceramic discharge vessel comprising a bulging section surrounding a discharge space and small-diameter cylindrical sections communicating with the ends of the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor; and a discharge medium containing a metal halide and filled in the translucent ceramic discharge vessel, and is characterized in that a ratio $R_T$ of the wall thickness of each small-diameter cylindrical section of the translucent ceramic discharge vessel to the diameter of the seal part of each power-supplying conductor is 0.98 or less.

In the twenty-third invention, the wall thickness of each small-diameter cylindrical section of the translucent ceramic discharge vessel is set within a prescribed range, thereby decreasing the probability that cracks develop during the manufacture or use of the high-voltage discharge lamp.

If the ratio $R_T$ exceeds 0.98, the temperature will greatly change in both the thickness direction of the translucent ceramic discharge vessel and the axial direction thereof, and cracks will likely develop.

The twenty-fourth high-voltage discharge lamp according to this invention is of the same type as the twenty-third high-voltage discharge lamp. It is characterized in that the ratio $R_T$ of the wall thickness of each small-diameter cylindrical section of the translucent ceramic discharge vessel to the diameter of the seal part of each power-supplying conductor is 0.90 or less.

In the twenty-fourth invention, a range more desirable than that specified in the twenty-third invention is defined.

The twenty-fifth high-voltage discharge lamp according to the invention is characterized by comprising: a translucent ceramic discharge vessel comprising a bulging section surrounding a discharge space and small-diameter cylindrical sections communicating with the ends of the bulging section; power-supplying conductors, each comprising a seal part and a halide-resistant part having a proximal end connected to the distal end of the seal part and each inserted in one small-diameter cylindrical section of the translucent ceramic discharge vessel, the halide-resistant part penetrating, forming a narrow gap between the halide-resistant part and the inner surface of the small-diameter cylindrical section; a pair of electrodes, each arranged at the distal end of one halide-resistant part and located in the bulging section of the translucent ceramic discharge vessel; seals made of ceramic-sealing compound, each sealing a junction between one small-diameter cylindrical section of the translucent ceramic discharge vessel and the seal part of one power-supplying conductor and covering a distal portion of the seal part over a distance of 0.2 to 3 mm; and a discharge medium containing a metal halide and filled in the translucent ceramic discharge vessel.

To secure the seal part of each power-supplying conductor to one small-diameter cylindrical section by applying ceramic-sealing compound and heating and melting the compound, it is necessary to cover the entire seal part inserted in the small-diameter cylindrical section with a seal, thereby to prevent a halide from corroding the seal part. If the proximal portion, too, is covered with the compound, however, the seal part will likely be corroded. Nonetheless, the seal part may be corroded while the lamp is on, if the compound covers the seal part over a distance of less than 0.2 mm. If the compound covers the seal part over a distance of more than 3 mm, crack will likely to develop.

The twenty-sixth high-voltage discharge lamp according to the present invention is of the same type as the first high-voltage discharge lamp and the fourth to twenty-fifth high-voltage discharge lamps. It is characterized in that the translucent ceramic discharge vessel has an internal volume of 0.1 cc or less.

The twenty-sixth invention is effective, particularly for a small, high-voltage discharge lamp having a translucent ceramic discharge vessel, which has an internal volume of 0.1 cc or less.

If the translucent ceramic discharge vessel has an internal volume of 0.1 cc or less, it is recommended that the vessel have a wall thickness of 1.5 mm or less.

It is also desired that the inter-electrode distance be 5 mm or less.

Further, it is desired that the input power of the high-voltage discharge lamp according to the twenty-sixth invention be 35 W or less.

The twenty-seventh high-voltage discharge lamp according to the invention is of the same type as the first high-voltage discharge lamp and the fourth to twenty-sixth high-voltage discharge lamps. It is characterized in that the translucent ceramic discharge vessel has an internal volume of 0.05 cc or less.

In the twenty-seventh invention, a more desirable range of the internal volume of the translucent ceramic discharge vessel is defined. The optimal value is 0.04 cc or more.

The twenty-eighth high-voltage discharge lamp according to this invention is of the same type as the high-voltage discharge lamp according to any one of the first to twenty-seventh inventions. It is characterized in that the translucent ceramic discharge vessel is made of YAG or yttrium oxide.

YAG and yttrium oxide are materials which are transparent, which have high average linear transmittance and which can be molded in any desired shape. They are excellent materials for translucent ceramic discharge vessels for use in smaller, high-voltage discharge lamps.

If these materials are used to make translucent ceramic discharge vessels, it will be possible to make a vessel comprising a bulging section and small-diameter sections, which are made integral and which define a continuous curved surface. In addition, the vessel will have a uniform wall thickness. The vessel can therefore serve to provide a high-voltage discharge lamp, which exhibits high optical efficiency when connected to an optically ideal point light source, which is thermally uniform, hardly to have cracks, and which has a long lifetime.

A high-voltage discharge lamp device according to the present invention is characterized by comprising: a high-voltage discharge lamp according to any one of the first to twenty-eighth inventions described above; and a reflecting mirror formed integral with the high-voltage discharge lamp and supporting the lamp, locating the luminescent center of the lamp almost at the focal point.

In the apparatus, the high-voltage discharge lamp is permanently secured to the reflecting mirror and thereby supported. This is desirable because the optical position relation between the lamp and the mirror would not alter. Nonetheless, the lamp may be removably connected to the mirror, if necessary.

The high-voltage discharge lamp and the reflecting mirror may be set in axial alignment, or the axis of the high-voltage discharge lamp may intersect at right angles with the optical axis of the reflecting mirror.

The high-voltage discharge lamp device of this invention may be removably attached to the main body of a lighting fixture, thereby providing a lighting apparatus for use in video photography. Alternatively, the high-voltage discharge lamp device may be used as a light source for optical fibers. Still alternatively, the apparatus can be used in various kinds of lighting means.

The first lighting apparatus according to the present invention is characterized by comprising: a high-voltage discharge lamp device according to this invention; a discharge-lamp lighting device arranged at the back of the reflecting mirror; and power-receiving means connected to the discharge lamp lighting device.

The discharge-lamp lighting device should better comprise a high-frequency lighting circuit having an inverter and current-limiting means, because these components help to reduce the size and weight of the device. In necessary, however, a low-frequency direct current may be supplied to the high-voltage discharge lamp through the current-limiting means. If this is the case, the current-limiting means can be an inductor, a resistor, or a capacitor.

The discharge-lamp lighting device may be fixed to the back of the high-voltage discharge lamp device, or may be removably attached to the back of the discharge lamp apparatus.

Furthermore, the discharge-lamp lighting device may be placed in a proper case, thereby providing a unit that has good outer appearance, that is easy to handle and that is safe.

The power-receiving means is designed to receive power from a power supply and supply the power to the discharge-lamp lighting device. The power-receiving means can be selected various types, such as one having a conductor wire connected to the power supply or one having a known-type tip to be attached to the lamp socket.

If the power-receiving mans is the type mentioned last, it can light the high-voltage discharge lamp in the same way as an incandescent lamp, when attached to a lamp socket for an ordinary incandescent lamp.

Bulb-shaped fluorescent lamps have come to be used in the same way as mentioned above. However, they cannot be used for such lighting purposes as would require directivity.

By contrast, it is possible with the present invention to achieve directional distribution of light as is desired, by means of the reflecting mirror. This is because the light-emitting section is virtually an ideal point light source.

It is feared that heat is generated and the temperature rises when the high-voltage discharge lamp is turned on. Nonetheless, the reflecting mirror decreases the heat radiation to the discharge-lamp lighting device. Thus, the discharge-lamp lighting device can be one designed for use in bulb-shaped fluorescent lamps.

Further, the reflecting mirror can reflect the heat emitted from the high-voltage discharge lamp, applying the heat back to the high-voltage discharge lamp. Heat loss can therefore be reduced, thereby enhancing the luminous efficiency.

Furthermore, the power-receiving means can be attached to the case of the discharge-lamp lighting device. If so, the lighting apparatus can be integral as a whole, becoming still easier to handle.

The second lighting apparatus according to this invention is of the same type as the first lighting apparatus and is characterized in that the high-voltage discharge lamp device and the discharge-lamp lighting device can be disconnected from each other.

Having this structure, the second lighting apparatus may comprise components common to other types of lamps.

More specifically, the discharge-lamp lighting device can be used not only for high-voltage discharge lamp device of this invention, but also for bulb-shaped fluorescent lamp devices. Moreover, the discharge-lamp lighting device can be used for various kinds of high-voltage discharge lamp devices that differ in light-distribution characteristic.

Thus, it is easy for manufacturers to accomplish component management and, hence, to lower the manufacturing cost of the lighting apparatus. If either the high-voltage discharge lamp device or the discharge-lamp lighting device fails to operate or comes to the end of its life, it can be replaced by a new one, while the other, which is flawless, is kept in use. Further, a high-voltage discharge lamp device having any desired light-distribution characteristic can be selected for a specific use. Still further, either a bulb-shaped fluorescent lamp device or a high-voltage discharge lamp device can be selected and used.

The third lighting apparatus according to this invention is characterized by comprising: a main body; and one of the first to twenty-eighth high-voltage discharge lamps described above.

The third lighting apparatus is based on the concept that the light emitted by a high-voltage discharge lamp is used for any purpose. It may be applied to a lighting fixture, a head light for vehicles, a light source for optical fibers, an image projector, an opto-chemistry apparatus, a fingerprint-identifying apparatus, and the like.

The main body is that part of the lighting apparatus, which is other than the high-voltage discharge lamp.

BEST MODE OF CARRYING OUT THE INVENTION

Figure 1:
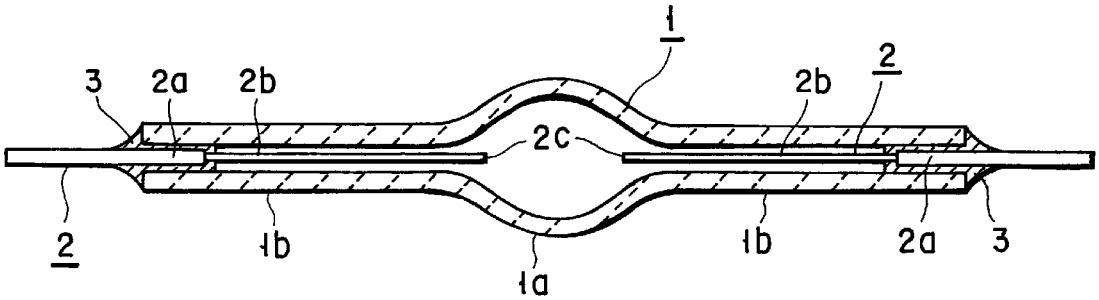
FIG. 1 is a sectional view showing the first high-voltage discharge lamp embodying the present invention.

FIG. 1 is a sectional view showing the first high-voltage discharge lamp embodying this invention.

In the figure, numeral 1 denotes a translucent ceramic discharge vessel, numeral 2 designates electrode-integrated power-supplying conductors, and numeral 3 indicates seals.

The translucent ceramic discharge vessel 1 comprises a bulging section 1*a* and small-diameter cylindrical sections 1*b*.

The bulging section 1*a* is a hollow, almost ellipsoidal cylinder. The ends of the section la are drawn, each given a continuous curved surface.

The small-diameter cylindrical sections 1*b* are connected to the bulging section 1*a*, and each has a curved surface continuous to the curved surface of one end of the bulging section 1*a*. The bulging section 1*a* and the sections 1*b* constitute the translucent ceramic discharge vessel 2.

Figure 2:
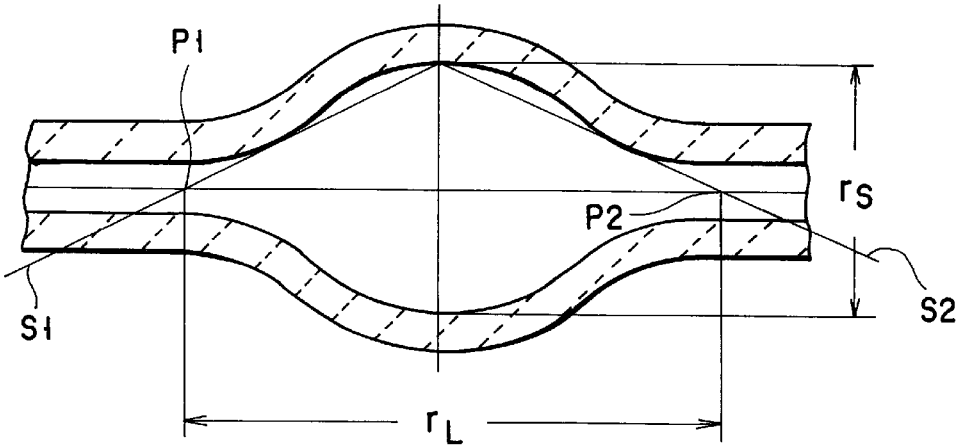
FIG. 2 is an enlarged, sectional view of the main part of the ellipsoidal, translucent ceramic discharge vessel of the high-voltage discharge lamp of the invention, explaining the standard for measuring the minor and major axes of the vessel.

FIG. 2 is an enlarged, sectional view of the main part of the ellipsoidal, translucent ceramic discharge vessel of the high-voltage discharge lamp of the invention, and explains the standard for measuring the minor and major axes of the vessel.

As shown in this figure, the minor diameter $r_S$ is the maximum inner diameter of the bulging section 1*a*. The major diameter $r_L$ is the distance between points P1 and P2 at which lines $s_1$ and $s_2$ intersect with the major axis c, respectively. Each of the lines $s_1$ and $s_2$ extends from one end of the minor diameter and is tangent to the inner surface of the junction between the bulging section 1*a* and one cylindrical section 1*b*. The length of each small-diameter cylindrical section 1*b* is the distance between the end of the major diameter $r_L$, i.e., point P1 or point P2, and the end of the small-diameter cylindrical section 1*b*.

Referring to FIG. 1 again, the lamp will be described further.

Each of the electrode-integrated power-supplying conductors comprises a seal part 2*a*, a halide-resistant part 2*b*, and a electrode part 2*c*.

The seal part 2*a* seals the translucent ceramic discharge vessel 1, at the junction between one power-supplying conductor 2 and one small-diameter cylindrical section 1*b*.

The halide-resistant part 2*b* is welded at its proximal end to the seal part 2*a*. The distal portion of the halide-resistant part 2*b* projects into the bulging section 1*a*. A narrow gap is provided between the halide-resistant part 2*b* and the inner surface of the small-diameter cylindrical section 1*b*.

The electrode part 2*c* is that portion of the halide-resistant part 2*b* which projects into the bulging section 1*a*.

Each seal 3 is interposed between one small-diameter section 1*b* and one seal part 2*b*, sealing the translucent ceramic discharge vessel 1 in airtight fashion and holding one electrode-integrated power-supplying conductor 2 at a prescribed position. To form the seal 3, ceramic-sealing compound is applied to the seal part 2*a* of the electrode-integrated power-supplying conductor 2, at the end of the small-diameter section 1*b*, and is heated and melted. The melted compound flows into the gap between the seal part 2*a* and the inner surface of the small-diameter cylindrical section 1, thus covering not only the seal part inserted in the small-diameter cylindrical section 1*b* but also the proximal portion of the halide-resistant part 2*b*.

The translucent ceramic discharge vessel 1 contains a discharge medium containing halide of light-emitting metal and rare gas.

EXAMPLE 1

It is a high-voltage discharge lamp of the type shown in FIG. 1, which has the following specification.

Translucent ceramic discharge vessel: made of YAG, having an overall length of 24 mm, and comprising a bulging section la having a major diameter of 6.5 mm, minor diameter of 3.5 mm, a wall thickness of 0.5 mm, and small-diameter sections each having an inner diameter of 0.75 mm, an outer diameter of 1.7 mm, and a length of 8 mm.

Electrode-integrated power-supplying conductors: each comprising a seal part 2*a*, or a niobium rod having an outer diameter of 0.65 mm and a halide-resistant part (and electrode) 2b, or tungsten rod having an outer diameter of 0.25 mm and a length of 6 mm. The narrow gap provided between the halide-resistant part 2*b* and the inner surface of one small-diameter cylindrical section lb is 0.25 mm.

The proximal portion of each halide-resistant part, covered with the seal 3, extended for a distance of 0.5 mm.

Discharge medium: 0.6 mg of NaI, 0.6 mg of TlI, 0.4 mg of InI, 2 mg of mercury, and about 13300 Pa of argon were sealed in the vessel.

The high-voltage discharge lamp, thus obtained, weighed 0.42 g. Its rated lamp power was 25 W. Hence, the ratio $R_L$ of the total weight (g) to the rated lamp power (W) was $1.7\times10^{-2}$ g/W.

The translucent ceramic discharge vessel 1 weighted 0.31 g. The ratio $R_E$ of the weight of the translucent ceramic discharge vessel 1 to the rated lamp power was therefore $1.2\times10^{-2}$ g/W.

The luminous efficiency was 671 m/W, and the color temperature was 3200 K.

EXAMPLE 2

This is a high-voltage discharge lamp of the type shown in FIG. 1, which has the following specification.

Translucent ceramic discharge vessel: made of aluminum oxide, having an overall length of 24 mm, and comprising a bulging section la having a major diameter of 5.0 mm, minor diameter of 3.5 mm, a wall thickness of 0.5 mm, and small-diameter sections each having an inner diameter of 0.70 mm, an outer diameter of 1.7 mm, and a length of 9.5 mm.

Electrode-integrated power-supplying conductors: each comprising a seal part 2*a*, or a niobium rod having an outer diameter of 0.64 mm and an overall length of 10 mm, and a halide-resistant part (and electrode) 2*b*, or tungsten rod having an outer diameter of 0.25 mm and a length of 7.5 mm. The narrow gap provided between the halide-resistant part 2*b* and the inner surface of one small-diameter cylindrical section lb is 0.25 mm. Each seal part 2*a* is inserted into the small-diameter cylindrical section 1*b* for a distance of 3.5 mm from the end thereof.

The proximal portion of each halide-resistant part, covered with the seal 3, extended for a distance of 1 mm.

Discharge medium: 1.5 mg of NaI, 0.8 mg of TlI, 1.2 mg of InI, 1.5 mg of mercury, and about 13300 Pa of argon were sealed in the vessel.

The rated lamp power was 20 W. The temperature of the coldest part was 780° C., and the temperature of the seals was 650° C. The luminous efficiency was 68 lm/w.

Figure 3:
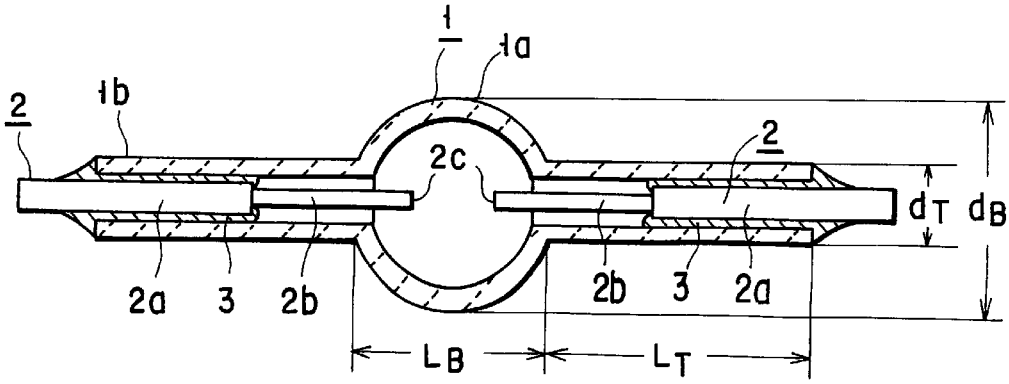
FIG. 3 is a sectional view showing the second high-voltage discharge lamp embodying the present invention.

FIG. 3 is a sectional view showing the second high-voltage discharge lamp embodying the present invention.

In the figure, the components identical to those shown in FIG. 1 are designated at the same reference numerals. These component will not be explained.

This embodiment differs in that the bulging section of the translucent ceramic discharge vessel 1 is almost spherical.

EXAMPLE 3

This is a high-voltage discharge lamp of the type shown in FIG. 2, which has the following specification.

Translucent ceramic discharge vessel: made of aluminum oxide, having an overall length of 39 mm and an internal volume of 0.08 cc, and comprising a bulging section la having a maximum outer diameter dl of 6.5 mm and a length L1 of 9 mm, and small-diameter sections each having an outer diameter d2 of 2.5 mm, an inner diameter of 1.5 mm and a length L2 of 15 mm.

Electrode-integrated power-supplying conductors: each comprising a seal part 2*a* of a niobium rod having an outer diameter of 2 mm and an overall length of 8 mm, and a halide-resistant part (and electrode) 2*b* of tungsten rod having an outer diameter of 1.7 mm and a length of 14 mm. The narrow gap provided between the halide-resistant part 2*b* and the inner surface of one small-diameter cylindrical section 1*b* is 0.4 mm. Each seal part 2*a* is inserted into the small-diameter cylindrical section 1*b* for a distance of 5 mm from the end thereof.

The distal portion of each halide-resistant part 2*b* extends into the bulging section 1*a*, forming an electrode. The inter-electrode distance is 4 mm.

The seals 3 are high-melting type, made by adding $Dy_2O_3$, $Nd_2O_3$ or the like to $Al_2O_3$—$SiO_2$.

Discharge medium: 0.6 mg of NaI, 0.1 mg of TlI, 0.4 mg of $DyI_3$, 0.8 mg of mercury, and about 2500 kPa of xenon were sealed in the vessel.

Figure 4:
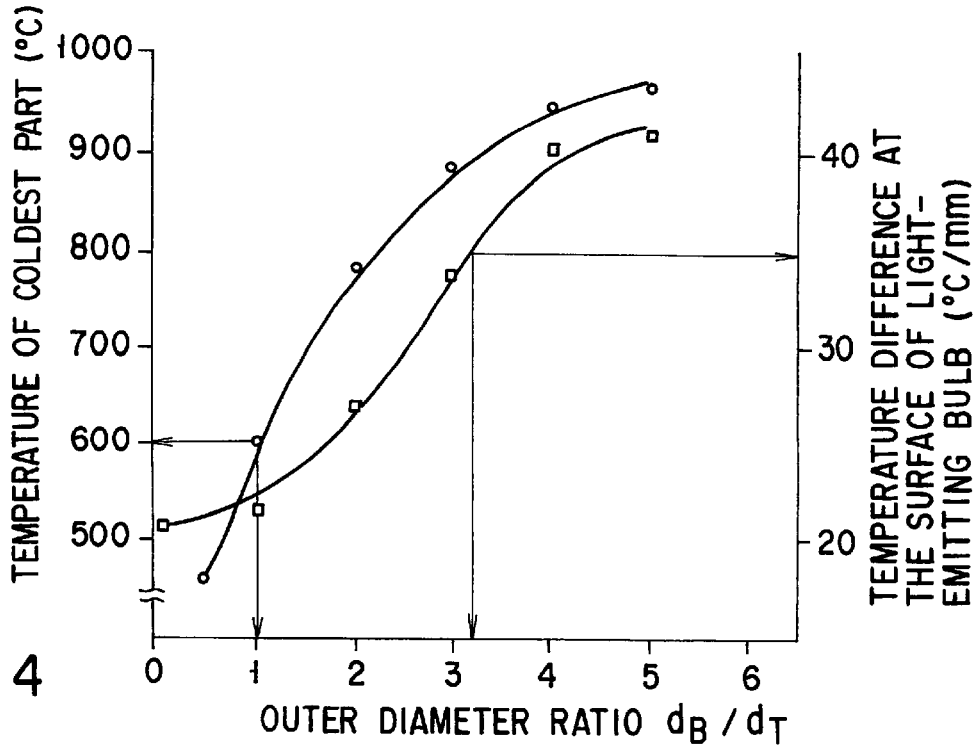
FIG. 4 is a graph showing the temperatures which the translucent ceramic discharge vessels of various high-voltage discharge lamps have at their coldest parts and surfaces as the outer-diameter ratio $d_B/d_T$ is changed, said high-voltage discharge lamps being similar to the high-voltage discharge lamp according to the second embodiment shown in FIG. 3 and being ones each contained in an outer bulb.

FIG. 4 is a graph showing the temperatures which the translucent ceramic discharge vessels of various high-voltage discharge lamps have at their coldest parts and surfaces as the outer-diameter ratio $d_B/d_T$ is changed, said high-voltage discharge charge lamps being similar to the high-voltage discharge lamp according to the second embodiment shown in FIG. 3 and being ones each contained in an outer bulb.

The lamps were lighted at lamp power of 60 W.

In the figure, the outer-diameter ratio $d_B/d_T$ is plotted on the abscissa axis, the temperature (° C.) of the coldest part is plotted on the left ordinate axis, and the surface-temperature difference (° C./mm) is plotted on the right ordinate axis.

Curve A indicates the temperature of the coldest part of the translucent ceramic discharge vessel 1. Curve B represents the surface-temperature difference of the translucent ceramic discharge vessel 1.

As seen from curve A, the outer-diameter ratio $d_B/d_T$ should be 1 or more in order to maintain the temperature of the coldest part at 600° C. or more.

As seen from curve B, it is desired that the outer-diameter ratio $d_B/d_T$ be 3.2 or less in order to set the surface-temperature difference of the translucent ceramic discharge vessel 1 at 35° C/mm or less so that cracks may hardly develop.

Figure 5:
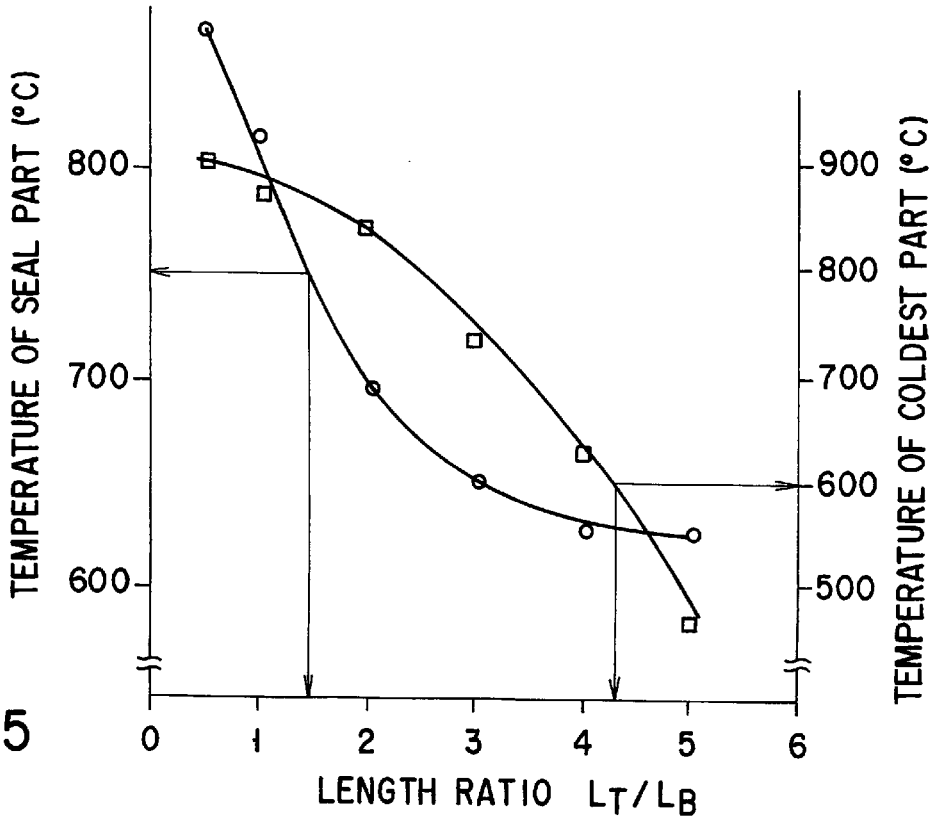
FIG. 5 is a graph showing the temperatures which the translucent ceramic discharge vessels of various high-voltage discharge lamps have at their coldest parts and surfaces as the length ratio $L_T/L_B$ is changed, said high-voltage discharge lamps being similar to the high-voltage discharge lamp according to the second embodiment shown in FIG. 4 and being ones each contained in an outer bulb.

FIG. 5 is a graph showing the temperatures which the translucent ceramic discharge vessels of various high-voltage discharge lamps have at their coldest parts and surfaces as the length ratio $L_T/L_B$ is changed, said high-voltage discharge charge lamps being similar to the high-voltage discharge lamp according to the second embodiment shown in FIG. 3 and being ones each contained in an outer bulb.

In the figure, the length ratio $L_T/L_B$ is plotted on the abscissa axis, the temperature of each seal (° C.) is plotted on the left ordinate axis, and the temperature (° C.) of the coldest part is plotted on the right ordinate axis.

Curve C indicates the temperature of sealing part. Curve D indicates the temperature of the coldest part.

As seen from curve C, the length ratio $L_T/L_B$should be 1.5 in order to maintain the seal part at 750° C. or less, because 750° C. is the highest temperature at which the seal can remain reliable.

As seen from curve D, it is desired that the length ratio $L_T/L_B$ be 4.3 or less in order to set the coldest part at 600° C. or more as is required in practice.

The luminous efficiency and lifetime of the high-voltage discharge lamp according to this example are shown in Table 1, along with those of some conventional lamps.

TABLE 1

| | Luminous efficiency (lm/w) | Non-lighting time (h) | Outer-diameter time ($d_B/d_T$) | Length ratio ($L_T/L_B$) |
|---|---|---|---|---|
| Present invention | 72.5 | >12000 | 2.6 | 1.67 |
| Conventional lamp 1 | 71.0 | 1250 (crack) | 5.2 | 1.67 |

TABLE 1-continued

| | Luminous efficiency (lm/w) | Non-lighting time (h) | Outer-diameter time ($d_B/d_T$) | Length ratio ($L_T/L_B$) |
|---|---|---|---|---|
| Conventional lamp 2 | 73.0 | 320 (leak) | 2.6 | 0.98 |
| Conventional lamp 3 | 51.2 | >12000 | 0.75 | 1.67 |
| Conventional lamp 4 | 48.3 | >12000 | 2.6 | 6.1 |

Figure 6:
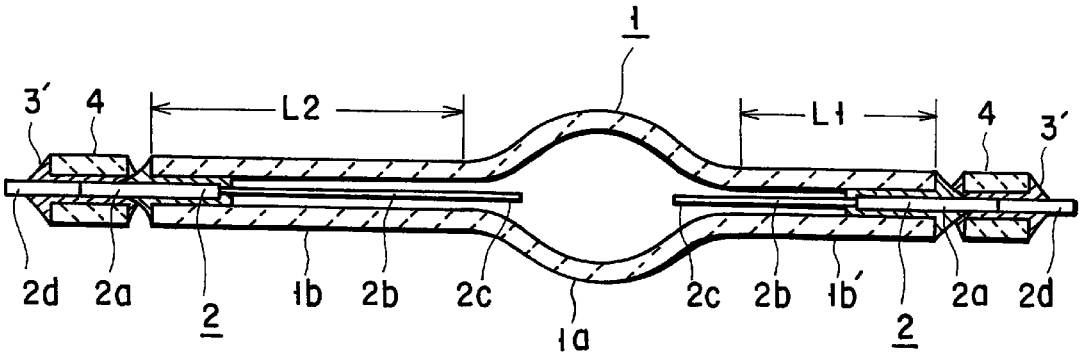
FIG. 6 is a sectional view showing the third high-voltage discharge lamp embodying the present invention.

FIG. 6 is a sectional view showing the third high-voltage discharge lamp embodying the present invention.

The components identical to those shown in FIG. 1 are designated at the same reference numerals-and will not be explained.

This example differs in that one small-diameter cylindrical section 1*b*' of the translucent ceramic discharge vessel 1 has a length L1 smaller than the length L2 of the other small-diameter cylindrical section 1*b*, and that it can be lighted in the atmosphere.

More specifically, a platinum rod 2*d* is welded to the proximal end of the seal part of each electrode-integrated power-supplying conductor 2. A ceramic sleeve 4 is mounted, surrounding the welded part of each rod 2*d*. A seal 3' made of ceramic-sealing compound covers the exposed portion of each seal part 2*a*.

EXAMPLE 4

This is a high-voltage discharge lamp of the type shown in FIG. 6, which has the following specification.

Translucent ceramic discharge vessel: made of YAG and comprising a bulging section la and two small-diameter cylindrical sections 1*b* and 1*b*'. The bulging section la has a major diameter of 6.5 mm, a minor diameter of 5.0 mm, a wall thickness of 0.5 mm, and an average linear transmittance of 45% at its main part. The bulging section 1*a* has been mechanically polished to have its average linear transmittance enhanced.

The small-diameter cylindrical sections 1*b* and 1*b*' have an inner diameter of 0.70 mm and an outer diameter of 1.7 mm. The section 1*b* has a length L1 of 7.0 mm, while the section 1*b*' has a length L2 of 10 mm. Each small-diameter cylindrical section has an average linear transmittance of 10%.

The translucent ceramic discharge vessel 1 thus constructed has an overall length of 23.5 mm.

The average linear transmittance of the main part of the translucent ceramic discharge vessel 1 is an arithmetical mean of the values measured at five points on the part that extends between the electrodes. The average linear transmittance of each small-diameter cylindrical section is an arithmetical mean of the values measured at five points spaced apart in the axial direction.

Electrode-integrated power-supplying conductors: each comprising a seal part 2*a* of a niobium rod having an outer diameter of 0.64 mm, and a halide-resistant part (and electrode) 2*b* of tungsten rod having an outer diameter of 0.28 mm and a length of 6 mm. The inter-electrode distance is 2 mm. Each seal part 2*a* is inserted into the small-diameter cylindrical section 1*b* for a distance of 3.5 mm from the end thereof.

The proximal portion of each halide-resistant part, covered with the seal 3 was 1 mm long.

Discharge medium: 0.6 mg of NaI, 0.4 mg of TlI, 0.6 mg of InI, 0.4 mg of $DyI_3$, 1.5 mg of mercury, and about 13300 Pa of xenon were sealed in the vessel.

The rated lamp power is 20 W.

The high-voltage discharge lamp of the example described above was incorporated into a reflecting mirror that has an aperture diameter of 35 mm and comprising an aluminum film formed by vapor deposition. The particulars of this lamp are shown in Table 2, along with those of some comparative examples.

TABLE 2

| | Average linear Transmittance (%) | | Relative efficiency (%) | | Failure |
|---|---|---|---|---|---|
| Lamp tested | Bulging section | Cylindrical section | Luminous efficiency | Luminaire efficiency | Ratio (%) |
| Example | 45 | 15 | 100 | 100 | 0 |
| Comparative example 1 | 45 | 45 | 91 | 99 | 25 |
| Comparative example 2 | 20 | 20 | 98 | 68 | 0 |

Comparative example 1 is of the same specification as the present example, except that the bulging section and the small-diameter cylindrical sections are polished and have an average linear transmittance of 45%.

Comparative example 2 is of the same specification as the present example, except that the small-diameter cylindrical sections are polished and have an average linear transmittance of 20%.

As seen from Table 2, the example has higher luminous efficiency, higher luminaire efficiency and lower failure ratio than the comparative examples 1 and 2.

Figure 7:
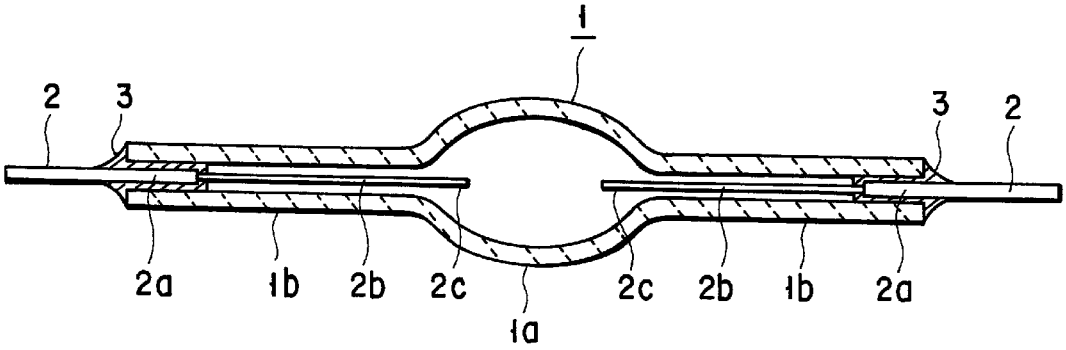
FIG. 7 is a sectional view showing the fourth high-voltage discharge lamp embodying the this invention.

FIG. 7 is a sectional view showing the fourth high-voltage discharge lamp embodying this invention.

In the figure, the components identical to those shown in FIG. 1 are designated at the same reference numerals. These components will not be explained.

This high-voltage discharge lamp differs in that the bulging section 1*a* of the translucent ceramic discharge vessel 1 is shaped like an ellipsoid and that the inter-electrode distance is therefore relatively long.

Figure 8:
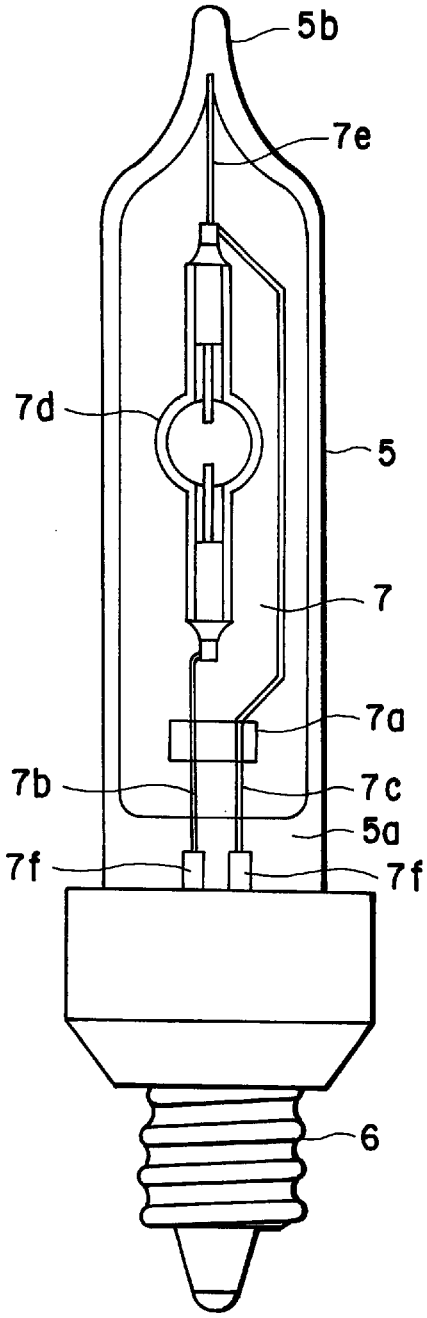
FIG. 8 is a front view showing the fifth high-voltage discharge lamp embodying the invention.

FIG. 8 is a front view showing the fifth high-voltage discharge lamp embodying the invention.

The present embodiment differs from the first lamp in that it has a double-tube structure for use in a lighting apparatus such as a spotlight.

Numeral 5 indicates an outer glass tube, numeral 5 denotes a cap, and numeral 7 indicates a bead mount.

The glass tube 5 is made of quartz glass. It has a pinch seal section 5*a* at the proximal end, and an evacuation chip section 5*b* at the distal end. The outer glass tube has been evacuated through the evacuation chip section 5*b*, and a vacuum has been created in the outer glass tube 5.

The cap 6 is of type E11, sealing the pinch seal section 5*a* of the glass outer tube 5 with cap cement.

The bead mount 7 comprises a bead glass 7*a*, conductors 7*b* and 7*c*, a light-emitting tube 7*d*, a support wire 7*e*, lead-in metal foils 7*f*, and outer conductors (not shown).

The bead glass 7*a* electrically insulates the conductors 7*b* and 7*c* and holds them together.

The conductor 7*b* is connected at the distal end to that power-supplying conductor 3 of the light-emitting tube 7*d*, which is provided in the cap 6. The conductor 7*c* is connected at the distal end to the power-supplying conductor 3 provided in the evacuation chip section 5*b*.

The light-emitting tube 7*d* is the second high-voltage discharge lamp according to the invention, which is shown in FIG. 3.

The support wire 7*e* is an extension of the conductor 7*c*, which extends upwards from the power-supplying conductor 3 as is illustrated in the figure. The wire 7*e* has its proximal end connected to the power-supplying conductor 3 provided in the evacuation chip section 5*b* and its distal end embedded in the evacuation chip section 5*b*.

The lead-in metal foils 7*f* are made of molybdenum and embedded in the pinch seal section 5*a* of the outer glass tube 5. They are connected at one end to the proximal ends of the conductors 7*a* and 7*c*, respectively, and at the other end to the outer conductors, respectively.

Hence, the light-emitting tube 7*d* is suspended in the outer glass tube 5 at a prescribed position by the glass bead 7*a*, between the support wire 7*e* of the bead mount 7 and the proximal ends of the conductors 7*b* and 7*c*.

Since a vacuum is maintained in the outer glass tube 5, the light-emitting tube 7*d* has a gentle temperature gradient while the lamp is lighted. If the airtight vessel 1 of the light-emitting tube 7*d* may be made of ceramics, cracks are likely to develop when the temperature difference in the airtight vessel exceeds a predetermined value. Nonetheless, cracks will hardly develop, because a vacuum is maintained in the outer glass tube 5.

Figure 9:
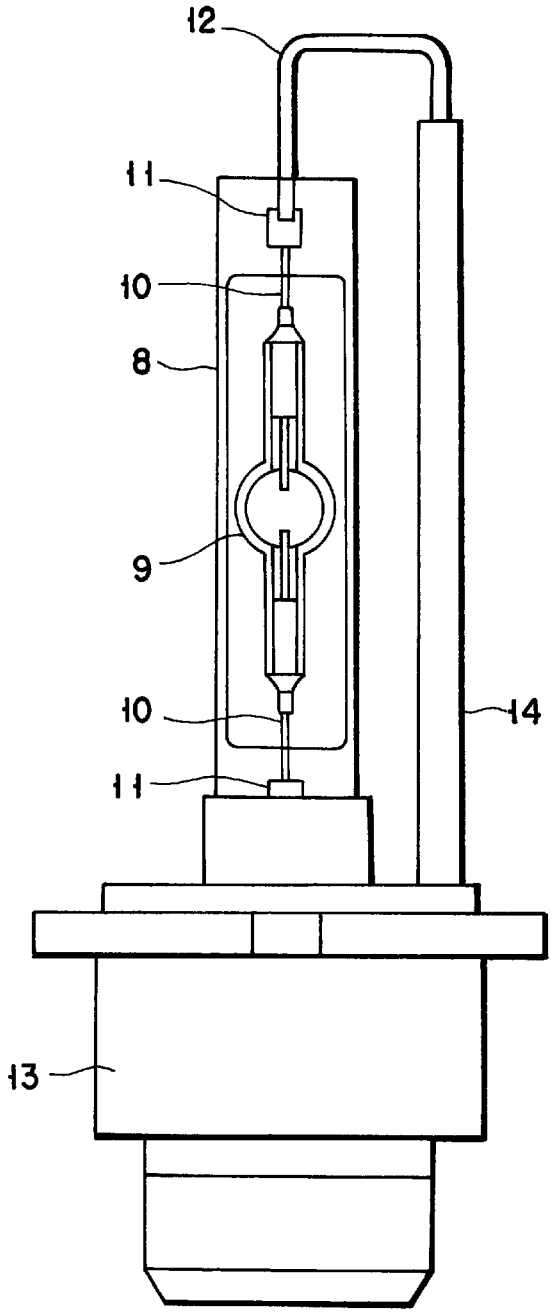
FIG. 9 is a front view showing the sixth high-voltage discharge lamp embodying the present invention.

FIG. 9 is a front view showing the sixth high-voltage discharge lamp embodying the present invention;

This embodiment differs from the first lamp in that it has a double-tube structure for use in headlights of automobile.

Numeral 8 indicates a outer glass tube 8, numeral 9 denotes a light-emitting tube, numeral 10 represents internal lead-in wires, numeral 11 indicates sealing metal foils, numeral 12 denotes an outer lead-in wire, numeral 13 indicates a cap, and numeral 14 represents an insulating tube.

The outer glass tube 8 is sealed at both ends with pinch seal sections 8*a*. A vacuum has been created in the outer glass tube 8.

The light-emitting tube 9 has the same structure as the high-voltage discharge lamp shown in FIG. 3.

The internal lead-in wires 10 are connected at one end to the power-supplying conductors provided at the ends of the light-emitting tube 9, and at the other end to the sealing metal foils 11.

The sealing metal foils 11 are embedded in airtight fashion in the pinch seal sections 8*a* of the outer glass tube 8.

The outer lead-in wire 12 has one end connected to the sealing metal foil 11, an intermediate portion extending parallel to the outer glass tube 8, and the other end connected to the cap 13.

The insulating tube 14 secured to that part of the outer lead-in wire 12, which extends parallel to the outer glass tube 8.

Figure 10:
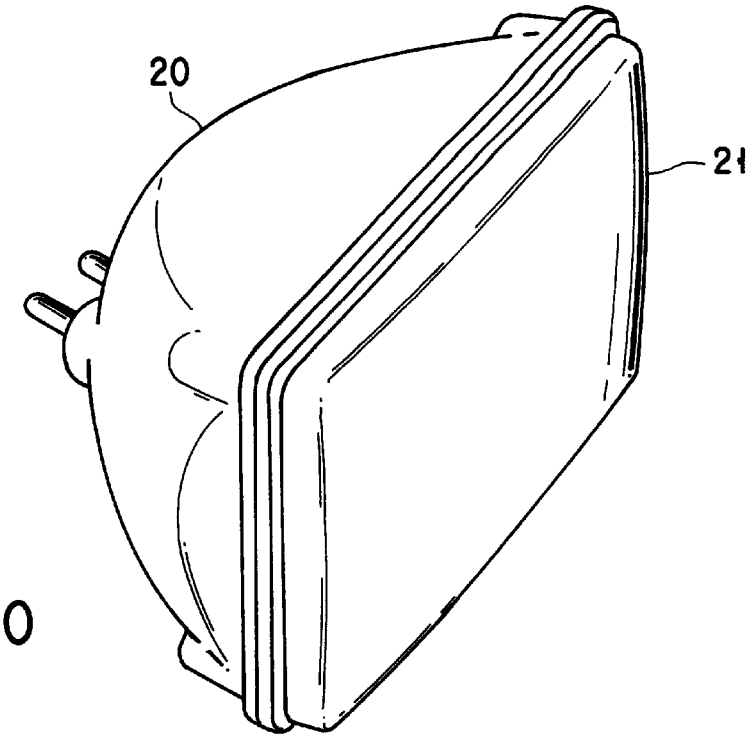
FIG. 10 is a perspective view of a head light for automobiles, which is the first lighting apparatus embodying this invention.

FIG. 10 is a perspective view of a head light for automobiles, which is the first lighting apparatus embodying this invention.

In the figure, numeral 20 designates a headlight body and numeral 21 denotes a front cover.

The headlight body 20 is a molding made of synthetic resin. Its inner surface is a reflecting surface made by vapor-depositing aluminum.

The front cover 21 is a molding made of transparent synthetic resin. It is secured to the front of the headlight body 20. It has a light-controlling means such as a lens or a prism, as is needed.

A metal halide discharge lamp, which is identical in structure to the sixth high-voltage discharge lamp embodying the invention, shown in FIG. 9, is removably attached, from the back of the head-light body 20.

Figure 11:
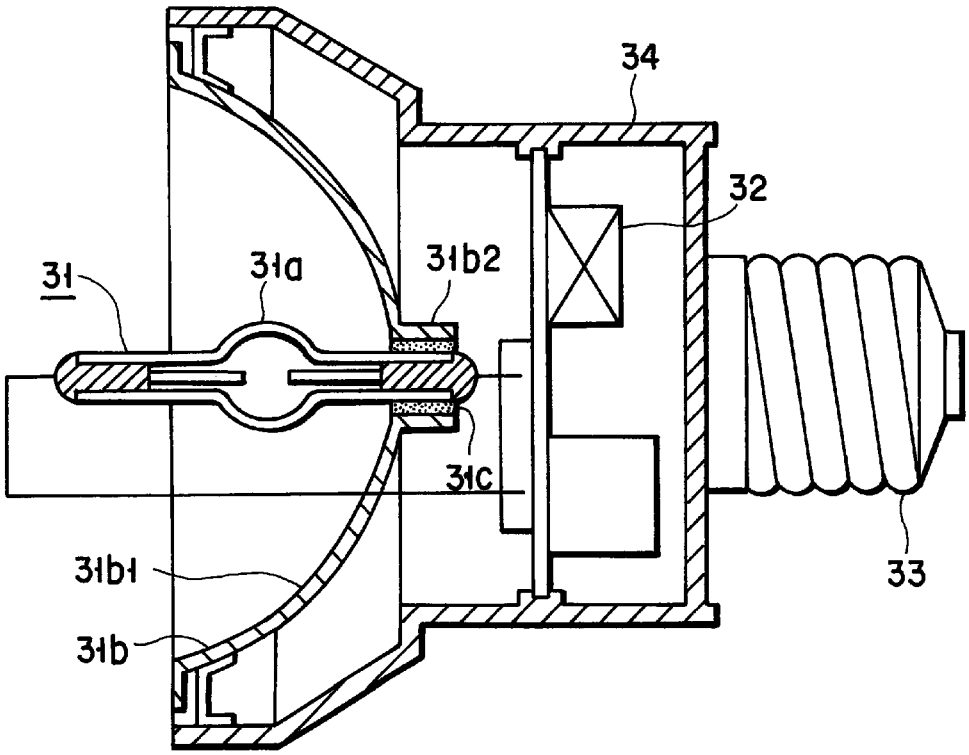
FIG. 11 is a sectional view showing the second lighting apparatus embodying the present invention.

FIG. 11 is a sectional view showing the second lighting apparatus embodying the present invention;

In the figure, numeral 31 indicates a high-voltage discharge lamp apparatus, numeral 32 designates a discharge-lamp lighting device, numeral 33 represents a power-receiving means, and numeral 34 is a case.

The high-voltage discharge lamp apparatus 31 comprises a high-voltage discharge lamp 31*a* and a reflecting mirror 31*b*.

The high-voltage discharge lamp 31*a* is a high-voltage discharge lamp according to the present invention. The lamp shown in FIG. 6 is preferably used. In this case, it is desirable to arrange the lamp, with the long small-diameter cylindrical section opposing the apical end of the reflecting mirror 31*b*.

The reflecting mirror 31*b* has a reflecting surface 31*b*1 and an apex opening 31*b*2. The small-diameter cylindrical section of the high-voltage discharge lamp 31*a* is held, by applying inorganic adhesive 31*c*, in the apex opening 31*b*2 of the mirror 31*b*, with the bulging section located almost at the focal point of the reflecting mirror 31*b*.

The discharge-lamp lighting device 32 comprises a high-frequency inverter and a current-limiting means and is designed to light the high-voltage discharge lamp 31*a*. The discharge-lamp lighting device 32 is arranged at the back of the reflecting mirror 31*b* of the high-voltage discharge lamp device 31.

The power-receiving means 33 comprises a threaded cap. Once the threaded cap is fitted in the lamp socket (not shown), power is received to energize the discharge-lamp lighting device 32.

The case 34 contains the components described above and holds them in a predetermined positional relation.

Figure 12:
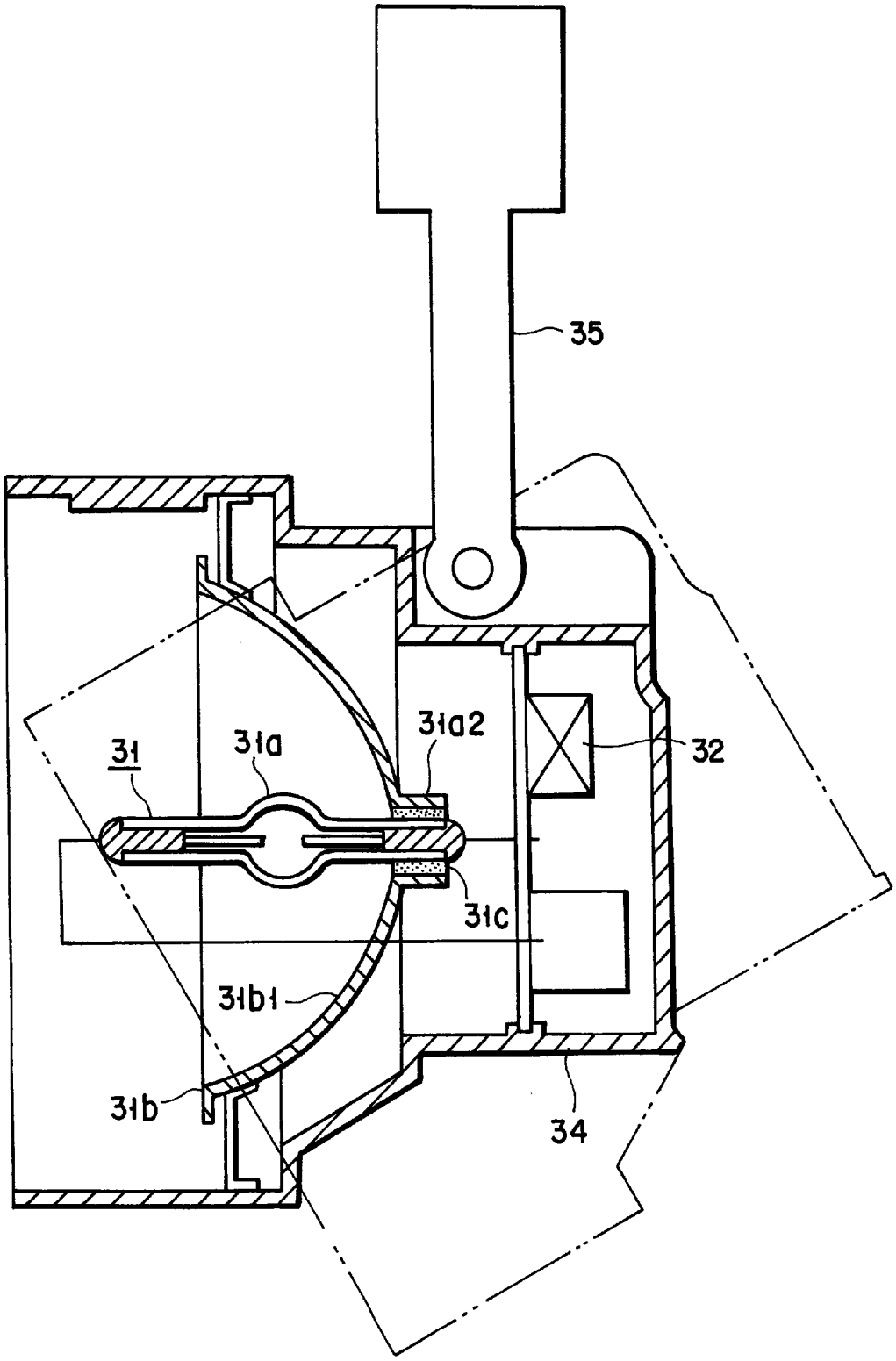
FIG. 12 is a sectional view showing the third lighting apparatus embodying the present invention;.

FIG. 12 is a sectional view showing the third lighting apparatus embodying the present invention.

In the figure, the components identical to those shown in FIG. 11 are designated at the same reference numerals. The components will not be explained.

The present embodiment differs in the structure of the power-receiving means.

More precisely, the case 34 is suspended from a lighting duct or the like by a suspending means 35, whereby the lighting apparatus is used as a spotlight. The power-receiving means (not shown) is a conductor wire inserted in the suspending means 35.

Figure 13:
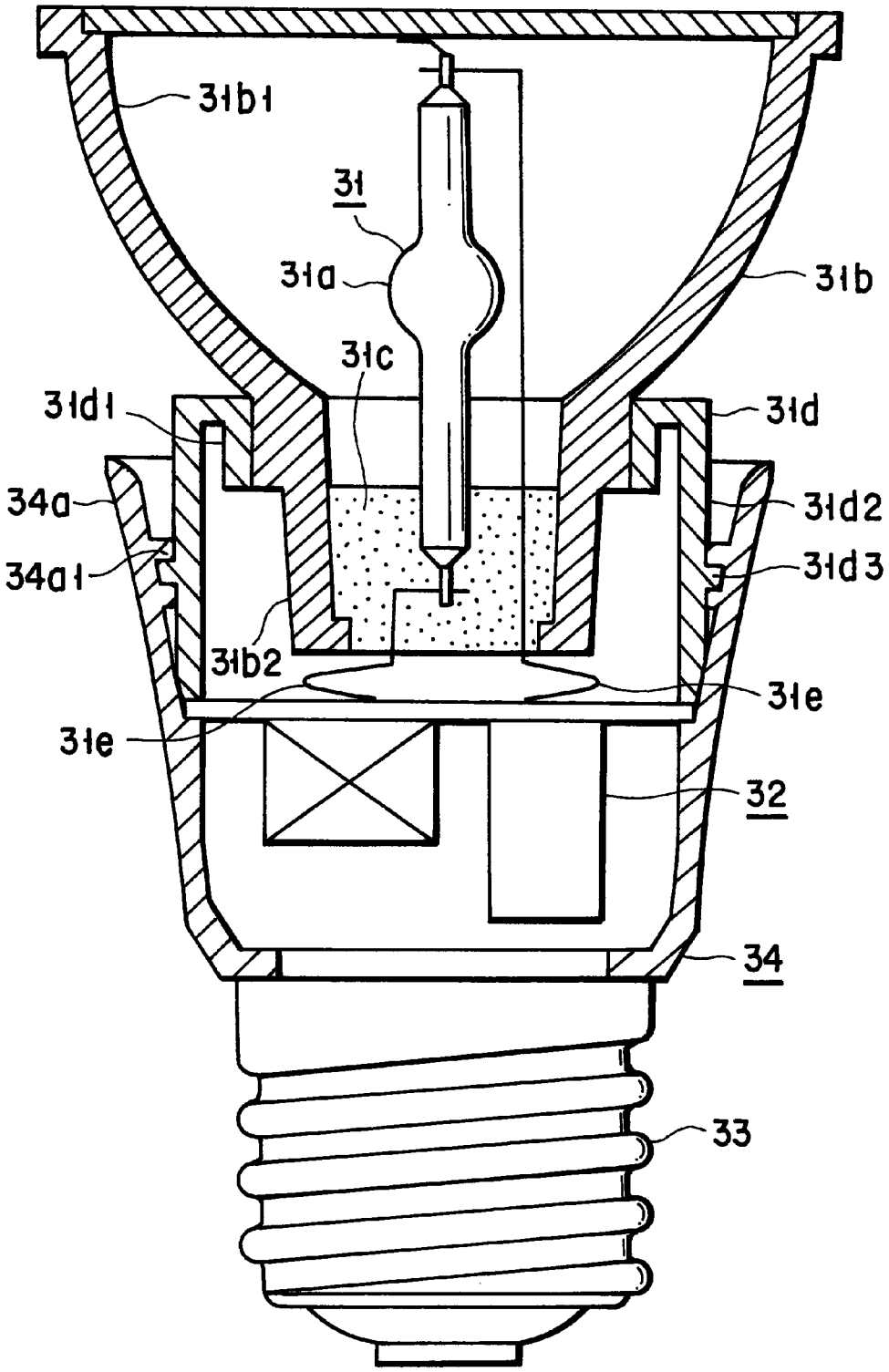
FIG. 13 is a sectional view showing the fourth lighting apparatus embodying the invention.

FIG. 13 is a sectional view showing the fourth lighting apparatus embodying the invention.

In the figure, the components identical to those shown in FIG. 11 are designated at the same reference numerals. The components will not be explained.

The present embodiment differs in that the high-voltage discharge lamp device 31 and the discharge-lamp lighting device 32 can be assembled easily.

That is, the high-voltage discharge lamp device 31 is provided with a holding cylinder 31*d* and contact strips 31*e*, and the case 34 has a receiving port 34*a*.

The holding cylinder 31*d* comprises a reflecting-mirror holding section 31*d*1 and a fitted cylinder section 31*d*2.

The reflecting-mirror holding section 31*d*1 holds the reflecting mirror 31*b* with adhesive or the like applied in the apex opening 31*b*2 of the mirror 31*b*.

A plurality of engagement projections 31*d*3 are arranged on the outer circumferential surface of the fitted cylinder section 31*d*2.

The contact strips 31*e* contact the electrodes of the high-voltage discharge lamp 31*a*, respectively. The receiving port 34*a* of the case 34 can receive the fitted cylinder section 31*d*2. A plurality of engagement grooves 34*a*1 are cut in the inner surface of the port 34*a*. The engagement projections 31*d*3 are fitted into the engagement grooves 34*a*1 when the cylinder section 31*d*2 is set in the port 34*a*.

The discharge-lamp lighting device 32 has output terminals (not shown), which are provided on, for example, a wiring board and which contact the contact strips 31*e* of the high-voltage discharge lamp device 31.

When the cylinder section 31*d*2 of the high-voltage discharge lamp device 312 is set in the receiving port 34*a* of the case 34, the engagement projections are fitted into the engagement grooves. At the same time, the contact strips 3*e* contact the output terminals of the discharge-lamp lighting device 32. The high-voltage discharge lamp device 31 is thereby electrically connected to the discharge-lamp lighting device 32. The discharge-lamp lighting device 32 can therefore light the high-voltage discharge lamp device 31. In other words, the assembling is completed.

Figure 14:
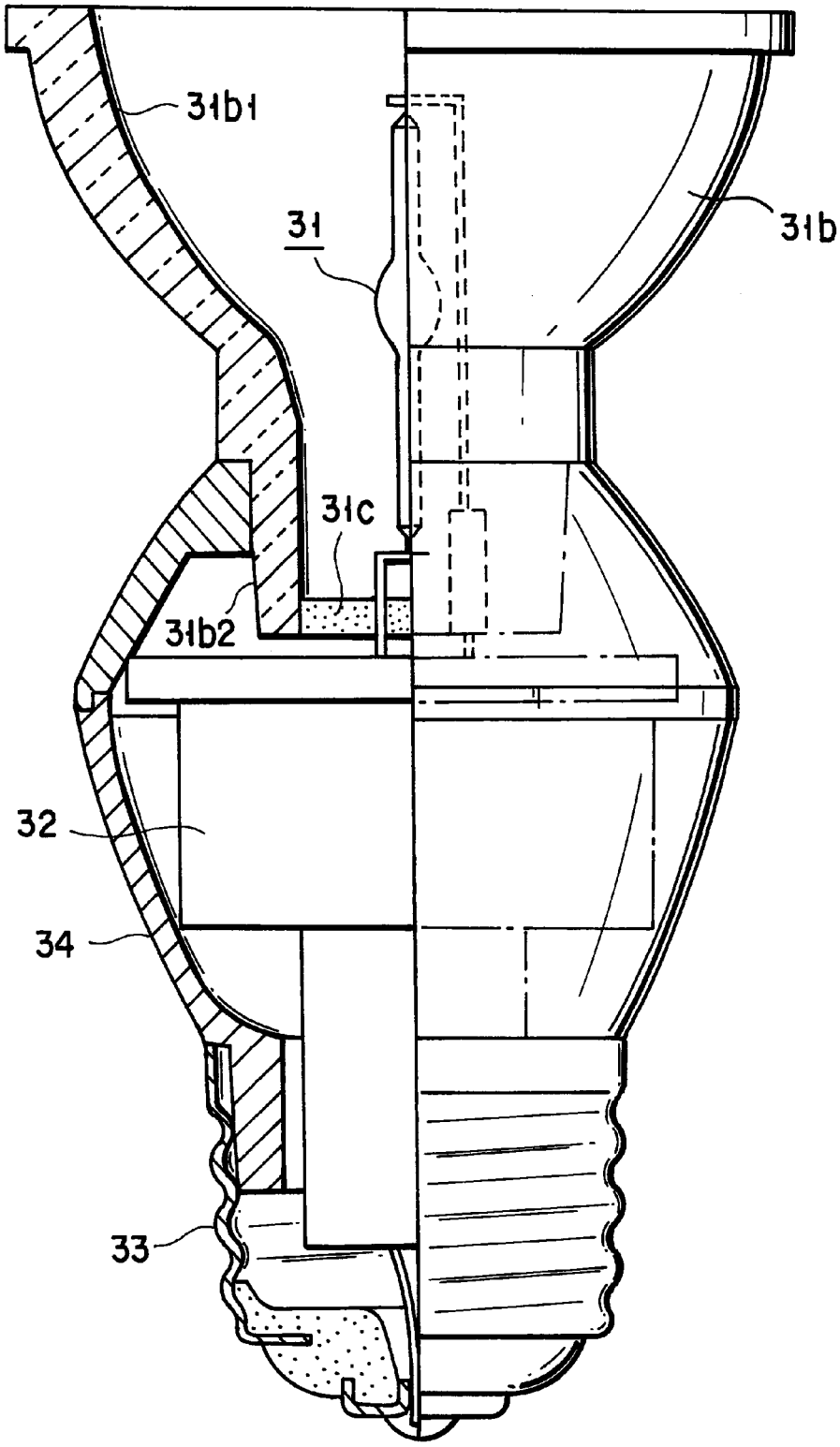
FIG. 14 is a sectional front view showing the fifth lighting apparatus embodying the present invention.

FIG. 14 is a sectional front view showing the fifth lighting apparatus embodying the present invention.

In the figure, the components identical to those shown in FIG. 11 are designated at the same reference numerals. The components will not be explained.

The present embodiment differs in that the case 34 is so shaped that it may be handled easily.

Figure 15:
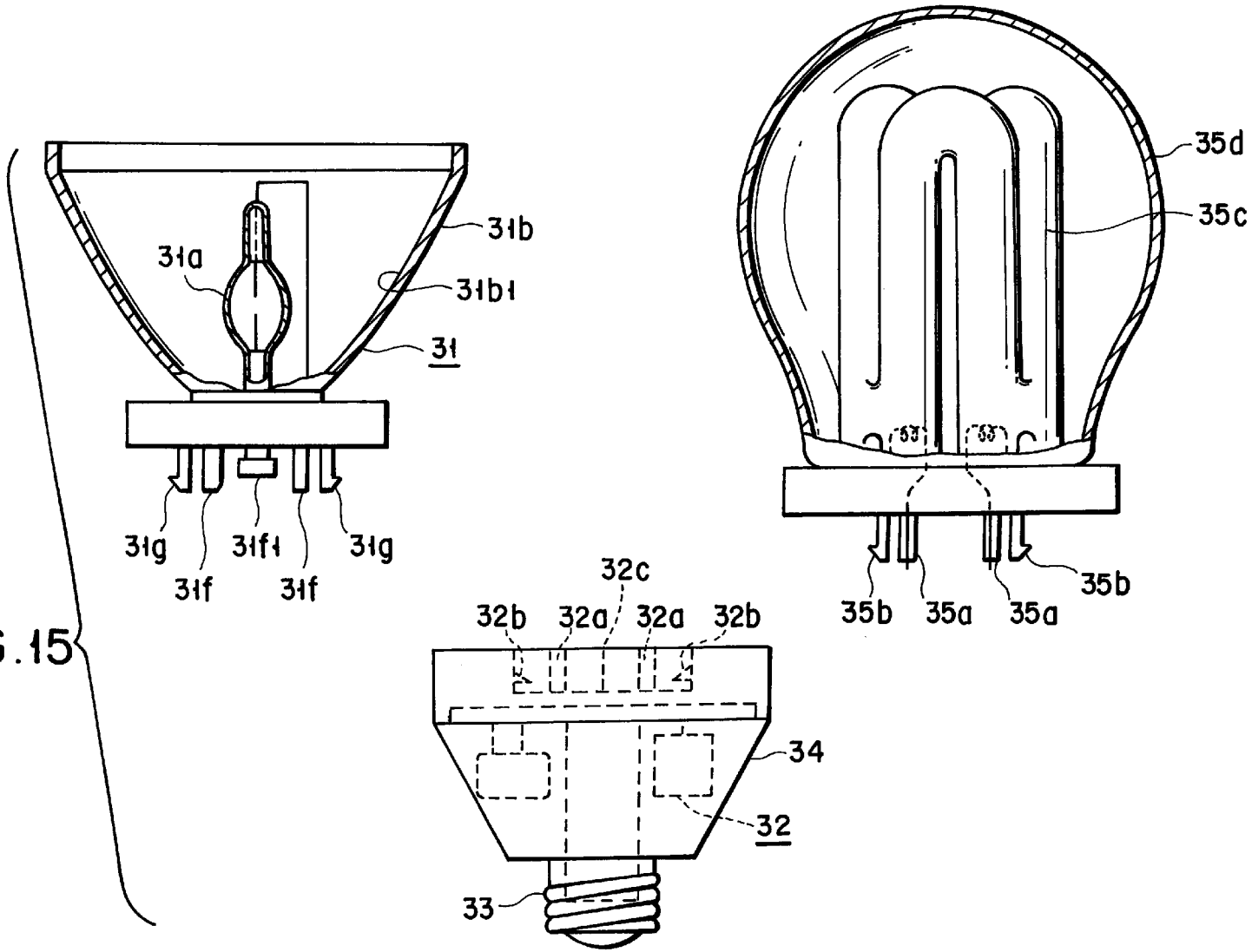
FIG. 15 is an exploded, partially sectional front view showing the sixth lighting apparatus embodying the invention.

More precisely, the case 34 is streamlined, so that the lighting apparatus may be suited as a down light. FIG. 15 is an exploded, partially sectional front view showing the sixth lighting apparatus embodying the invention.

Figure 16:
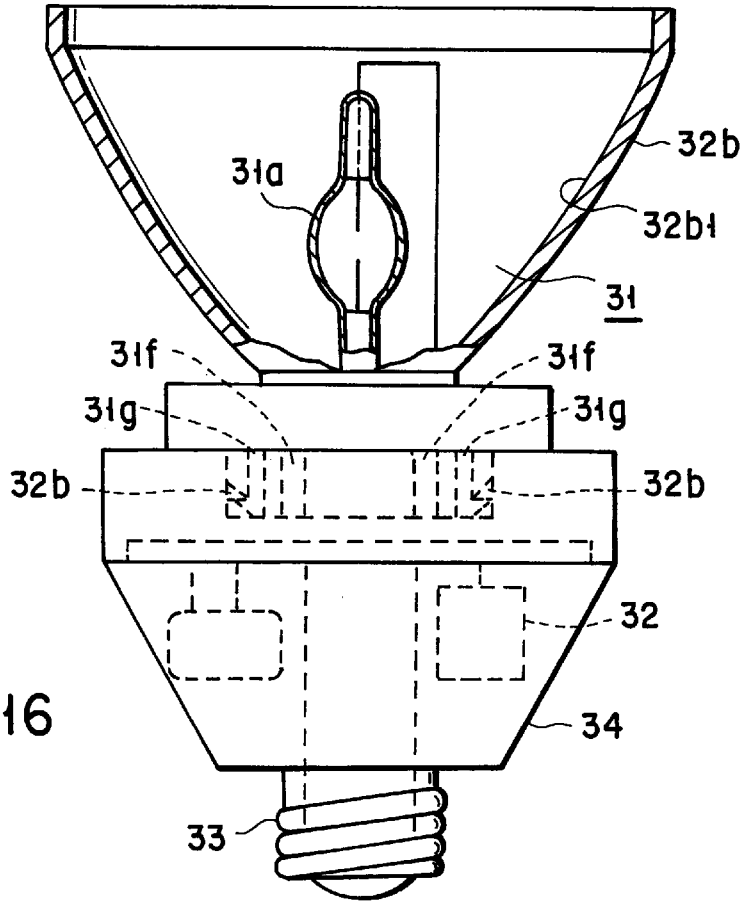
FIG. 16 is a partially sectional front view of the apparatus, with the components assembled together.

FIG. 16 is a partially sectional front view of the apparatus, with the components assembled together.

In the figure, the components identical to those shown in FIG. 11 are designated at the same reference numerals. The components will not be explained.

The present embodiment differs in that the high-voltage discharge lamp device 31 and the discharge-lamp lighting device 32 can be separated from each other and that the lamp device 31 can be replaced by a bulb-shaped fluorescent lamp.

That is, the high-voltage discharge lamp device 31 has, at its proximal end, an electrical connection means 31*f* and a mechanical connection means 31*g*.

The electrical connection means 31*f* is connected to the electrodes of the high-voltage discharge lamp 31*a* in the high-voltage discharge lamp device 31. The electrical connection means 31*f* has a starting circuit connection means 31*b*1. The starting circuit connection means 31*f* is connected to one of the electrodes in the high-voltage discharge lamp device 31. The conductor extending from this electrode is connected to the other electrode or is extended to a position where it opposes the other electrode. The lighting of the lamp device can thereby be started with ease.

The mechanical connection means 31*g* functions to connect the high-voltage discharge lamp device 31 mechanically to the discharge-lamp lighting device 32.

The discharge-lamp lighting device 32 is provided with an electrical connection means 32*a* and a mechanical connection means 32*b*.

The electrical connection means 32*a* is connected to the output terminals of the device 32, in the discharge-lamp lighting device 32. The electrical connecting means 32*a* has a starting circuit connection means 32*a*1. The starting circuit connection means 32*a*1 is connected to the output terminal of the starting circuit in the device 32 and also to the starting circuit connection means 31*f*1 of the high-voltage discharge lamp device 31.

The mechanical connection means 32*b* cooperates with the mechanical connection means 31*g* of the high-voltage discharge lamp device 31, connecting the high-voltage discharge lamp device 31 and the discharge-lamp lighting device 32 together.

To accomplish mechanical connection, both mechanical connection means are pushed onto each other, or pushed onto each other and then rotated, to be connected together.

At the same time the mechanical connection means are thus mechanically connected, the electrical connection means 31*f* and 32*b* are connected together. At this time, the starting circuit connection means 31*f*1 and 32*a*1 are mutually connected, too. Hence, the high-voltage discharge lamp 31*a* can be lighted only if the power-receiving means 33 is connected to a power supply.

The discharge-lamp lighting device 32 can be used in combination with a bulb-shaped fluorescent lamp if this lamp is identical or similar to the lamp device 31 in rated lamp power and rated lamp voltage. In this case, the electrical connection means 35*a* and mechanical connection means 35*b* of the bulb-shaped fluorescent lamp 35 must have the same rated values as those of the high-voltage discharge lamp device 31. Numeral 35*c* denotes a fluorescent lamp, and numeral 35*d* designates a glove.

The discharge-lamp lighting device 32 is contained in the case 34, and the power-receiving means 33 is supported by the case 34. It does not matter essentially if the discharge-lamp lighting device 32 incorporates a starting circuit.

Figure 17:
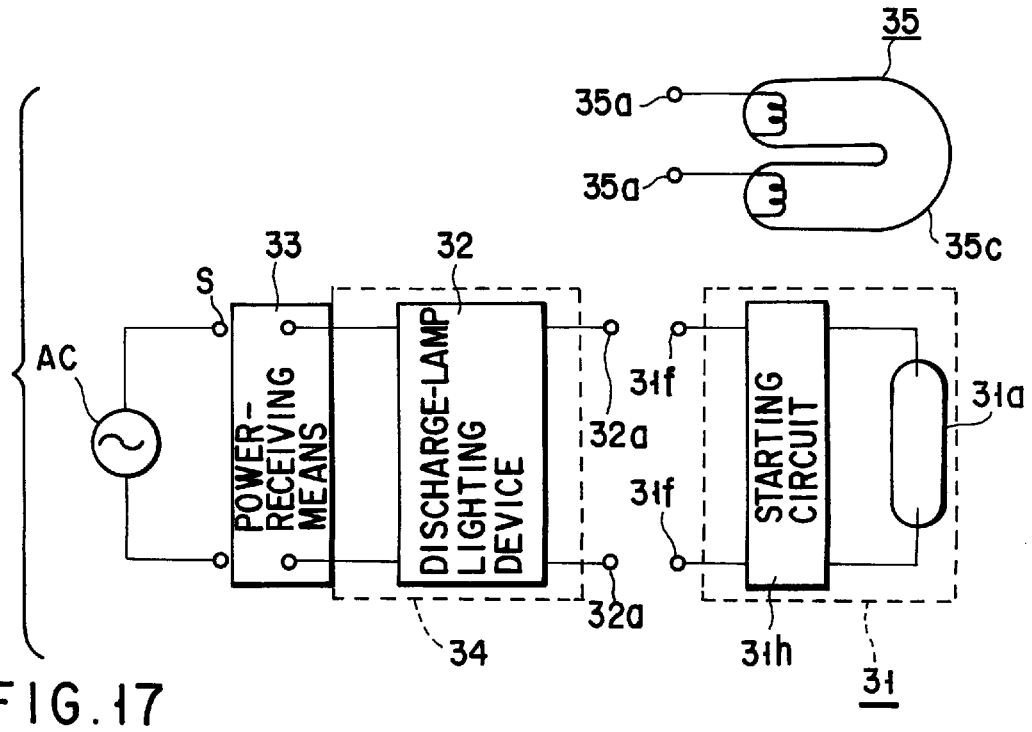
FIG. 17 is a circuit diagram showing the seventh lighting apparatus embodying the present invention.

FIG. 17 is a circuit diagram showing the seventh lighting apparatus embodying the present invention.

In the figure, the components identical to those shown in FIG. 15 are designated at the same reference numerals. The components will not be explained.

The present embodiment differs in that the starting circuit 31*h* for the high-voltage discharge lamp 31*a* is incorporated in the high-voltage discharge lamp device 31.

In the figure, AC designates an alternating current source, and S denotes a lamp socket.

What is claimed is:

1. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section; and having an inner diameter smaller than the spherical, bulging section;

electrode-integrated power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section and, said halide-resistant part penetrating the spherical, bulging section of the light-transmitting ceramic discharge vessel, forming a narrow gap between the halide-resistant part and the inner surface of the small diameter cylindrical section, and each having a distal end projecting into the spherical, bulging section of the light-transmitting ceramic discharge vessel and forming an electrode part;

seals made of ceramic-sealing compound, each sealing a junction between one small diameter cylindrical section of the light-transmitting ceramic discharge vessel and one electrode-integrated power-supplying conductor;

a discharge medium containing a metallic halide and filled in the light-transmitting ceramic discharge vessel; and said spherical, bulging section having a ratio $R_D$ of the minor diameter to the major diameter, wherein the following formula is satisfied:

$$0.3 \leqq R_D \leqq 1.0.$$

2. A high-voltage discharge lamp according to claim 1, wherein the following formula is satisfied:

$$0.2 \leqq \phi H/\phi S \leqq 0.6$$

where $\phi S$ (mm) is the diameter of each seal part and $\phi H$ (mm) is the diameter of each halide-resistant part.

3. A high-voltage discharge lamp comprising:

a light-transmitting ceramic discharge vessel having an internal volume of 0.05 cc or less and comprising a spherical, bulging section and small diameter cylindrical sections continuously and integrally communicating with the ends of the spherical, bulging section, said spherical, bulging section having both ends drawn and given a continuous curved surface, and said small diameter cylindrical sections having an inner diameter smaller than the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor;

a discharge medium containing a metal halide and filled in the light-transmitting ceramic discharge vessel; and said spherical, bulging section having a ratio $R_D$ of the minor diameter to the major diameter, wherein the following formula is satisfied:

$$0.3 \leqq R_D \leqq 1.0.$$

4. A high-voltage discharge lamp comprising:

a light-transmitting ceramic discharge vessel having an internal volume of 0.05 cc or less and comprising a spherical, bulging section having a maximum outer diameter $d_B$ (mm) and a length $L_B$ (mm) and a pair of small diameter cylindrical sections continuously and integrally communicating with the ends of the spherical, bulging section, each having an outer diameter $d_T$ (mm) and a length $L_T$ (mm);

a pair of electrodes sealed in the small diameter cylindrical sections and located in the spherical, bulging section, each comprising a seal part and a halide-resistant part having a proximal end connected to the distal end of the seal tart and each inserted in one small diameter cylindrical section of the light-transmitting ceramic discharge vessel without a solid material between said each halide-resistant part and said one small diameter cylindrical section, said halide-resistant part forming a narrow gap between the halide-resistant part and the inner surface of the small diameter cylindrical section;

a discharge medium containing a light-emitting metallic halide and a rare gas and filled in the light-transmitting ceramic discharge vessel, said vessel satisfying the following formulas:

$$1 \leqq d_B/d_T \leqq 3.5$$

$$1.6 \leqq L_T/L_B \leqq 4.5; \text{ and}$$

said spherical, bulging section having a ratio $R_D$ of the minor diameter to the major diameter, wherein the following formula is satisfied:

$$0.3 \leqq R_D \leqq 1.0.$$

5. A high-voltage discharge lamp according to claim 4 wherein the light-transmitting ceramic discharge vessel satisfies the following formulas:

$$2 \leqq d_B/d_T \leqq 3.2$$

$$2 \leqq L_T/L_B \leqq 3.7.$$

6. A high-voltage discharge lamp comprising:

a light-transmitting ceramic discharge vessel having an internal volume of 0.05 cc or less and comprising a spherical bulging section and small diameter cylindrical sections continuously and integrally communicating with the ends of the spherical, bulging section and having an inner diameter smaller than the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting discharge vessel;

seals made of ceramic-sealing compound, each sealing a junction between one small diameter cylindrical section of the light-transmitting ceramic discharge vessel and the seal part of one power-supplying conductor;

a discharge medium containing a metallic halide and filled in the light-transmitting ceramic discharge vessel; and said spherical, bulging section having a ratio $R_D$ of the minor diameter to the major diameter, wherein the following formula is satisfied:

$$0.3 \leqq R_D \leqq 1.0.$$

7. A high-voltage discharge lamp according to claim 6, wherein the ratio $R_D$ of the minor diameter to the major diameter satisfies the following formula:

$$0.5 \leqq R_D \leqq 0.95.$$

8. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section and having an inner diameter smaller than the spherical, bulging section, said vessel having a wall-thickness difference of 0.4 mm or less;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor;

a discharge medium containing a metal halide and filled in the light-transmitting ceramic discharge vessel; and said spherical, bulging section having a ratio $R_D$ of the minor diameter to the major diameter, wherein the following formula is satisfied:

$$0.3 \leqq R_D \leqq 1.0.$$

9. A high-voltage discharge lamp according to claim 8, wherein the small wall-thickness of the light-transmitting ceramic discharge vessel is 0.2 mm or less.

10. A high-voltage discharge lamp comprising:

a light-transmitting ceramic discharge vessel having an overall length of 40 mm or less, having an internal volume of 0.05 cc or less and comprising a spherical, bulging section and small diameter cylindrical sections continuously and integrally communicating with the ends of the spherical, bulging section, said spherical, bulging section having both ends drawn and given a continuous curved surface, and said small diameter cylindrical sections having an inner diameter smaller than the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor;

a discharge medium containing a metal halide and filled in the light-transmitting ceramic discharge vessel; and said spherical, bulging section having a ratio $R_D$ of the minor diameter to the major diameter, wherein the following formula is satisfied:

$$0.3 \leqq R_D \leqq 1.0.$$

11. A high-voltage discharge lamp according to claim 10, wherein the light-transmitting ceramic discharge vessel has an over-all length of 30 mm or less.

12. A high-voltage discharge lamp comprising:

a light-transmitting ceramic discharge vessel having an internal volume of 0.05 cc or less and comprising a spherical, bulging section and small diameter cylindrical sections continuously and integrally communicating with the ends of the spherical, bulging section, said spherical, bulging section having both ends drawn and given a continuous curved surface, and said small diameter cylindrical sections having an inner diameter smaller than the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor;

a discharge medium containing a metal halide and filled in the light-transmitting ceramic discharge vessel;

wherein said lamp has a rated lamp power of 35 W or less; and said spherical, bulging section having a ratio RD of the minor diameter to the major diameter, wherein the following formula is satisfied:

$$0.3 \leqq R_D \leqq 1.0.$$

13. A high-voltage discharge lamp according to claim 12, wherein the rated lamp power is 20 W or less.

14. A high-voltage discharge lamp comprising:

a light-transmitting ceramic discharge vessel having an internal volume of 0.05 cc or less and comprising a spherical, bulging section and small diameter cylindrical sections continuously and integrally communicating with the ends of the spherical, bulging section, said spherical, bulging section having both ends drawn and given a continuous curved surface, and said small diameter cylindrical sections having an inner diameter smaller than the spherical, bulging section and having an average linear transmittance smaller than that of the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor;

a discharge medium containing a metal halide and filled in the light-transmitting ceramic discharge vessel; and said spherical, bulging section having a ratio $R_D$ of the minor diameter to the major diameter, wherein the following formula is satisfied:

$$0.3 \leqq R_D \leqq 1.0.$$

15. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor; and a discharge medium containing a metal halide and filled in the light-transmitting ceramic discharge vessel;

wherein a ratio $R_L$ of the total weight (g) to the rated lamp power (W) satisfies the following formula:

$$0.7 10^{-2} \leqq R_L \leqq 2.5 \times 10^{-2}; \text{ and}$$

said spherical, bulging section having a ratio $R_D$ of the minor diameter to the major diameter, wherein the following formula is satisfied:

$$0.3 \leqq R_D \leqq 1.0.$$

16. A high-voltage discharge lamp according to claim 15, wherein the ratio $R_L$ of the total weight (g) to the rated lamp power (W) satisfies the following formula:

$$0.8 \times 10^{-2} \leqq R_L \leqq 2.0 \times 10^{-2}.$$

17. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor; and a discharge medium containing a metal halide and filled in the light-transmitting ceramic discharge vessel;

wherein a ratio $R_E$ of the total weight (g) light-transmitting ceramic discharge vessel to the rated lamp power (W) satisfies the following formula:

$$0.5 \times 10^{-2} \leqq R_E \leqq 2.2 \times 10^{-2}; \text{ and}$$

said spherical, bulging section having a ratio $R_D$ of the minor diameter to the major diameter, wherein the following formula is satisfied:

$$0.3 \leqq R_D \leqq 1.0.$$

18. A high-voltage discharge lamp according to claim 17, the ratio $R_E$ of the total weight (g) of the light-transmitting ceramic discharge vessel to the rated lamp power (W) satisfies the following formula:

$$0.6\times10^{-2}\leqq R_E\leqq1.8\times10^{-2}.$$

19. A high-voltage discharge lamp comprising:

a light-transmitting ceramic discharge vessel having an internal volume of 0.05 cc or less and comprising a spherical, bulging section surrounding a discharge space and having an inner diameter $r_I$ (mm), a first small diameter cylindrical section continuously and integrally communicating with one end of the spherical, bulging section and having a length L1, and a second small diameter cylindrical section continuously and integrally communicating with the other end of the spherical, bulging section and having a length L2 (mm);

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor; and a discharge medium containing a metal halide and filled in the light-transmitting ceramic discharge vessel;

wherein the inner diameter $r_1$, of the spherical, bulging section and the lengths L1 and L2 of the first and second small diameter cylindrical sections satisfy the following formula:

$$r_1/2<L1<L2;\text{ and}$$

said spherical, bulging section having a ratio $R_D$ of the minor diameter to the major diameter, wherein the following formula is satisfied:

$$0.3\leqq R_D\leqq1.0.$$

20. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap of 0.21 mm or more between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor; and a discharge medium containing a metal halide and filled in the light-transmitting ceramic discharge vessel; and said spherical, bulging section having a ratio $R_D$ of the minor diameter to the major diameter, wherein the following formula is satisfied:

$$0.3\leqq R_D\leqq1.0.$$

21. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor; and a discharge medium containing a metallic halide and filled in the light-transmitting ceramic discharge vessel;

wherein a ratio $R_T$ of the wall thickness of each small diameter cylindrical section of the light-transmitting ceramic discharge vessel to the diameter of the seal part of each power-supplying conductor is 0.98 or less: and said spherical, bulging section having a ratio $R_D$ of the minor diameter to the major diameter, wherein the following formula is satisfied:

$$0.3\leqq R_D\leqq1.0.$$

22. A high-voltage discharge lamp according to claim 21, wherein the ratio $R_T$ of the wall thickness of each small diameter cylindrical section of the light-transmitting ceramic discharge vessel to the diameter of the seal part of each power-supplying conductor is 0.90 or less.

23. A high-voltage discharge lamp comprising:

a light-transmitting ceramic discharge vessel having an internal volume of 0.05 cc or less and comprising a spherical, bulging section surrounding a discharge space and small diameter cylindrical sections continuously and integrally communicating with the ends of the spherical, bulging section;

power-supplying conductors, each comprising a seal part and a halide-resistant part having a proximal end connected to the distal end of the seal part and each inserted in one small diameter cylindrical section of the light-transmitting ceramic discharge vessel without a solid material between said each halide-resistant part and said one small diameter cylindrical section, said halide-resistant part penetrating the spherical, bulging section of the light-transmitting ceramic discharge vessel, forming a narrow gap between the halide-resistant part and the inner surface of the small diameter cylindrical section;

a pair of electrodes, each arranged at the distal end of one halide-resistant part and located in the spherical, bulging section of the light-transmitting ceramic discharge vessel;

seals made of ceramic-sealing compound, each sealing a junction between one small diameter cylindrical section of the light-transmitting ceramic discharge vessel and the seal part of one power-supplying conductor and covering a distal portion of the seal part over a distance of 0.2 to 3 mm;

a discharge medium containing a metal halide and filled in the light-transmitting ceramic discharge vessel; and said spherical, bulging section having a ratio RD of the minor diameter to the major diameter, wherein the following formula is satisfied:

$$0.3 \leqq R_D \leqq 1.0.$$

24. A high-voltage discharge lamp according to claim 1, characterized in that the (translucent) light-transmitting ceramic discharge vessel is made of YAG or yttrium oxide.

25. A high-voltage discharge lamp device characterized by comprising:

a high-voltage discharge lamp according to claim 1; and a reflecting mirror formed integral with the high-voltage discharge lamp and supporting the lamp, locating the luminescent center of the lamp almost at the focal point.

26. A lighting apparatus comprising:

a high-voltage discharge lamp device according to claim 1;

a discharge-lamp lighting device arranged at the back of the reflecting mirror; and power-receiving means connected to the discharge lamp lighting device.

27. A lighting apparatus according to claim 1, characterized in that the high-voltage discharge lamp device and the discharge-lamp lighting device can be disconnected from each other.

28. A lighting apparatus comprising:

a main body; and a high-voltage discharge lamp according to claim 1.

* * * * *

UNITED STATES PATENT AND TRADEMARK OFFICE

CERTIFICATE OF CORRECTION

PATENT NO. : 6,215,254 B1
DATED : April 10, 2001
INVENTOR(S) : H. Honda et al.

It is certified that error appears in the above-identified patent and that said Letters Patent is hereby corrected as shown below:

Title page, Item [54], and Column 1, lines 1-3,
Title, "HIGH-VOLTAGE DISCHARGE LAMP, HIGH-VOLTAGE DISCHARGE LAMP DEVICE, AND LIGHTING DEVICE" should read -- HIGH-VOLTAGE DISCHARGE LAMP, HIGH- VOLTAGE DISCHARGE LAMP DEVICE, AND LIGHTING APPARATUS --

Item [75], Inventors, "Hisahi" should read -- Hisashi --

Column 32,
Line 14, "tart" should read -- part --
Line 46, "spherical bulging" should read -- spherical, bulging --

Column 35,
Line 1, "ratio RD" should read -- ratio $R_D$ --

Column 36,
Line 11, "$0.710^{-2}$" should read -- $0.7x10^{-2}$ --

Column 38,
Lines 55-57, the following clause should be single indented, not double indented: "said spherical, bulging section having a ratio $R_D$ of the minor diameter to the major diameter, wherein the following formula is satisfied:"

Column 40,
Line 1, "ratio RD" should read -- ratio $R_D$ --

Signed and Sealed this

Ninth Day of July, 2002

*Attest:*

*Attesting Officer*

JAMES E. ROGAN
*Director of the United States Patent and Trademark Office*